US011707099B1

(12) United States Patent
Aguilar et al.

(10) Patent No.: US 11,707,099 B1
(45) Date of Patent: Jul. 25, 2023

(54) TAPE ATTACHMENT SYSTEMS AND METHODS

(71) Applicant: SoftWear Automation, Inc., Cumming, GA (US)

(72) Inventors: Edgar Aguilar, Austell, GA (US); Michael J. Baker, Acworth, GA (US); Scott Coleman, Atlanta, GA (US); John Casey Edgerton, Roswell, GA (US); Jason Franklin, Marietta, GA (US); Luther R. Lloyd, III, Dallas, GA (US); Louis Marion Mieszkowski, Atlanta, GA (US); Jorge Augusto Parra, Johns Creek, GA (US)

(73) Assignee: SOFTWEAR AUTOMATION, INC., Cumming, GA (US)

( * ) Notice: Subject to any disclaimer, the term of this patent is extended or adjusted under 35 U.S.C. 154(b) by 0 days.

(21) Appl. No.: 17/721,229

(22) Filed: Apr. 14, 2022

(51) Int. Cl.

| | |
|---|---|
| ***A41D 27/24*** | (2006.01) |
| ***D05B 35/06*** | (2006.01) |
| ***D05B 27/00*** | (2006.01) |
| ***D05B 33/00*** | (2006.01) |

(52) U.S. Cl.
CPC ..... *A41D 27/245* (2013.01); *D05B 35/06* (2013.01); *D05B 27/00* (2013.01); *D05B 33/00* (2013.01)

(58) Field of Classification Search
CPC ..... D05B 35/02; D05B 35/06; D05B 35/102; D05B 35/10; D05B 27/00; D05B 33/00
See application file for complete search history.

(56) References Cited

U.S. PATENT DOCUMENTS

| | | | | |
|---|---|---|---|---|
| 4,784,071 | A * | 11/1988 | Sadeh | D05B 35/102 112/470.07 |
| 6,055,921 | A * | 5/2000 | Olewicz | D05B 33/00 112/470.36 |
| 6,123,041 | A * | 9/2000 | Adamski, Jr. | D05B 35/066 112/470.07 |
| 2013/0048219 | A1* | 2/2013 | Ferreiro | D06H 5/00 156/513 |
| 2014/0259278 | A1* | 9/2014 | Feldman | A41D 27/245 2/114 |

* cited by examiner

*Primary Examiner* — Nathan E Durham
(74) *Attorney, Agent, or Firm* — Thomas | Horstemeyer, LLP

(57) ABSTRACT

Various examples are provided related to attachment of tape or strips of material along a seam of a garment or other material. In one example, among others, a robotic system includes a joining device that can attach a tape or strip of material across a seam, a loading system that can position material with the seam for attachment of the tape or strip of material, a seam feed system that can adjust positioning of the material for attachment, and a tape handling system that can supply the tape or strip of material to the joining head of the joining device for attachment across the seam. A tape handling system can include a tape joining assembly that can receive tape or strip of material from a current tape cartridge and bond it to the tape or strip of material clamped by the tape joining assembly.

26 Claims, 13 Drawing Sheets

TAPE ATTACHMENT SYSTEMS AND METHODS

BACKGROUND

In garment production, tape can be added across seams to add structure or increase their strength. For example, in knit shirts such as undershirts or t-shirts the shoulder and neck seams can be reinforced to accommodate for stretching experienced during normal wear. Shoulder tape can be positioned across the seam and attached to both pieces of fabric to absorb the stress applied during stretching of the shirt material. The shoulder tape can extend over the seam at the back of the neck and/or the seams along the top of the shoulders. In manual sewing operations, maintaining consistent alignment of the seam and shoulder tape during sewing is a skill that takes time to master. For fully automated processes, this operation is complicated by the varying curvature which increases the difficulty of alignment with the seam.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also correspond to implementations of the claimed technology.

BRIEF DESCRIPTION OF THE DRAWINGS

The accompanying drawings illustrate various examples of systems, methods, and embodiments of various other aspects of the disclosure. Any person with ordinary skills in the art will appreciate that the illustrated element boundaries (e.g., boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles. Moreover, in the drawings, like reference numerals designate corresponding parts throughout the several views.

DETAILED DESCRIPTION

Figure 1:
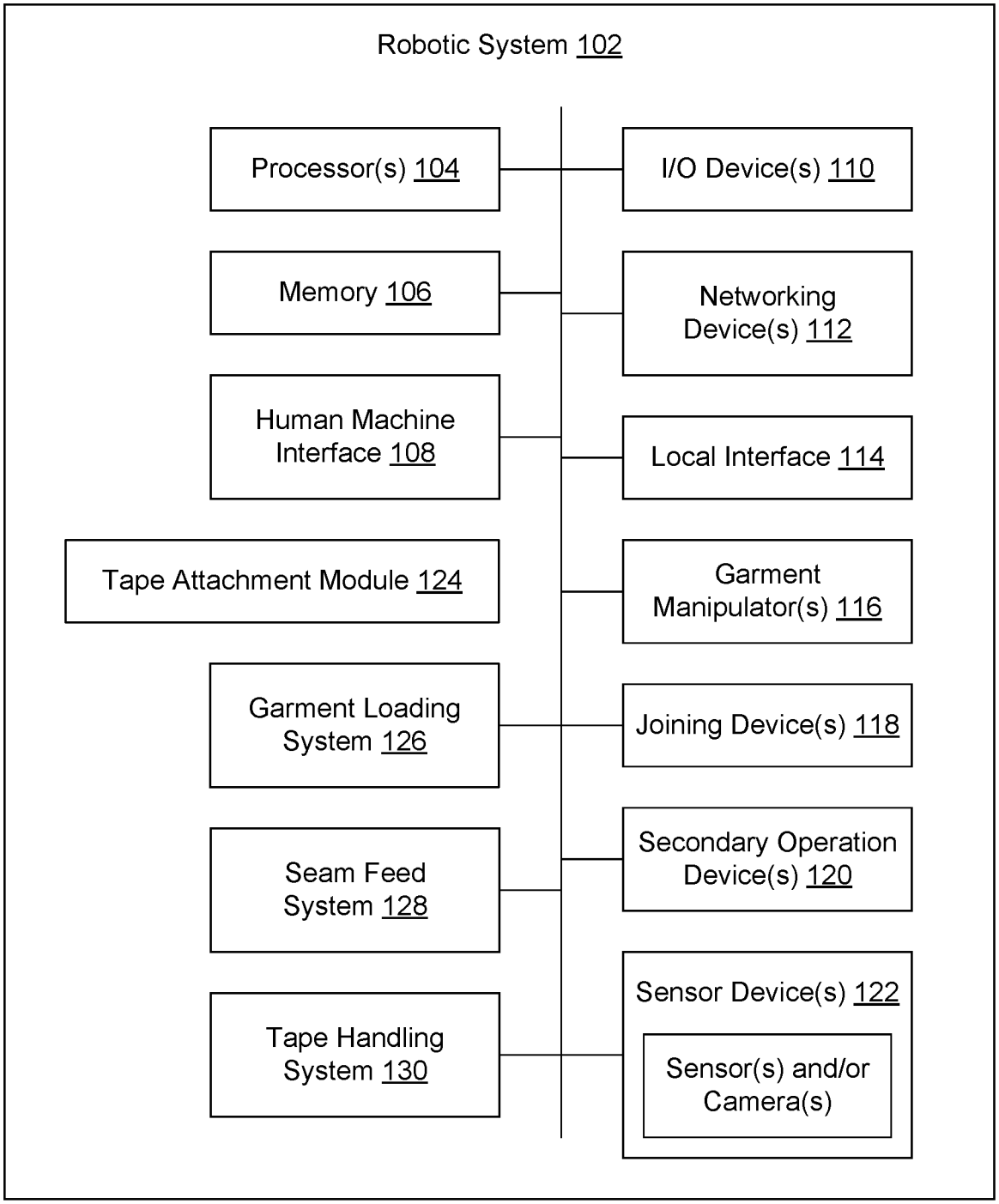
FIG. 1 illustrates an example of a tape attachment system, according to various embodiments of the present disclosure.

Disclosed herein are various examples related to automation of sewing or bonding using robots. Reference will now be made in detail to the description of the embodiments as illustrated in the drawings. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context clearly dictates otherwise. Although any systems and methods similar or equivalent to those described herein can be used in the practice or testing of embodiments of the present disclosure, the preferred, systems, and methods are now described.

Embodiments of the present disclosure will be described hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

Referring to FIG. 1, shown is an example of a system that can be used for attachment of reinforcing tape or other reinforcing strips of material along seams in, e.g., garments or other sewn products. This tape can be used e.g. for decoration, to reenforce a seam, to stiffen a seam, or to reduced wear and/or chaffing during use. Examples of products that this system may be used for include, but are not limited to, garments, tents, bags, backpacks, pillows, etc. In the context of this disclosure, a garment refers to garments or portions of garments being processed by the system for the attachment of the tape or strip of material (e.g., fabric, textiles, plastic sheeting, etc.). For example, the system can be used to attach reinforcing tape or strips of material along seams in shirts or other garments (e.g., pants, shorts, dresses, etc.). As noted above, attachment of the tape or strips can be used for more than apparel. Reinforcing tape is generally a continuous strip of material with a uniform or substantially uniform width, which can be affixed over or across a seam of a garment or other item. While the examples provided in this disclosure are presented in the context of garment materials, the technology is equally applicable to other items fabricated with seams or joints that can be reinforced. The reinforcing tape can also include joined strips of material.

As illustrated in the example of FIG. 1, the system can comprise a robotic system 102, which can include a processor 104, memory 106, an interface such as, e.g., a human machine interface (HMI) 108, I/O device(s) 110, networking device(s) 112, and a local interface 114. The robotic system can also include garment manipulator(s) 116, a joining device 118, secondary operation device(s) 120, and/or sensing device(s) 122. The sensing device(s) 122 can comprise a sensor, camera or other vision device such as, e.g., an RGB camera, an RGB-D camera, a near infrared (NIR) camera, stereoscopic camera, photometric stereo camera (single camera with multiple illumination options), etc. Additionally, the robotic system 102 can include a garment loading system 126, seam feed system 128, and/or tape handling system 130, which may be utilized in the processing of the garments.

The robotic system 102 can position, e.g., a seam of a garment with respect to a reinforcing tape while the reinforcing tape is attached across the seam by the joining device 118. The garment loading system 126 can receive a garment and position it for attachment of reinforcing tape provided by the tape handling system 130. The seam is covered by the reinforcing tape for joining. Positioning of the seam can be controlled by the seam feed system 128 with respect to the reinforcing tape and/or the joining device while the reinforcing tape is being joined to the garment. When the joining (e.g., sewing or bonding) is complete, the processed garment can be removed from the garment loading system 126. The garment can be manually loaded on and/or removed from the garment loading system 126. In more fully automated processes, the garment manipulator(s) 116 can be used to autonomously place and/or remove the garment on the garment loading system 126.

The processor 104 can be configured to decode and execute any instructions received from one or more other electronic devices or servers. The processor can include one or more general-purpose processors (e.g., INTEL® or Advanced Micro Devices® (AMD) microprocessors) and/or one or more special purpose processors (e.g., digital signal processors or Xilinx® System on Chip (SOC) field programmable gate array (FPGA) processor). The processor 104 may be configured to execute one or more computer-readable program instructions, such as program instructions to carry out any of the functions described in this description.

The memory 106 can include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions. The memory 106 can comprise modules that can be implemented as a program executable by processor(s) 104.

The interface(s) or HMI 108 can either accept inputs from users or provide outputs to the users or may perform both the actions. In one case, a user can interact with the interfaces using one or more user-interactive objects and devices. The user-interactive objects and devices may comprise user input buttons, switches, knobs, levers, keys, trackballs, touchpads, cameras, microphones, motion sensors, heat sensors, inertial sensors, touch sensors, or a combination of the above. Further, the interfaces can either be implemented as a command line interface (CLI), a graphical user interface (GUI), a human machine interface (HMI), a voice interface, or a web-based user-interface.

The input/output devices or I/O devices 110 of the robotic system 102 can comprise components used to facilitate connections of the processor 104 to other devices such as, e.g., garment manipulator(s) 116, joining device 118, secondary operation device(s) 120, sensing device(s) 122, garment loading system 126, seam feed system 128, and/or tape handling system 130 and can, for instance, comprise one or more serial, parallel, small system interface (SCSI), universal serial bus (USB), IEEE 1394 (i.e., Firewire™), or other appropriate connection elements.

The networking device(s) 112 of the robotic system 102 can comprise the various components used to transmit and/or receive data over a network. The networking device(s) 112 can include a device that can communicate both inputs and outputs, for instance, a modulator/demodulator (i.e. modem), a radio frequency (RF) or infrared (IR) transceiver, a telephonic interface, a bridge, a router, as well as a network card, etc.

The local interface 114 of the robotic system 102 can be, for example, but not limited to, one or more buses or other wired or wireless connections, as is known in the art. The local interface 114 can have additional elements, which are omitted for simplicity, such as controllers, buffers (caches), drivers, repeaters, and receivers, to enable communications. Further, the local interface 114 can include address, control, and/or data connections to enable appropriate communications among the components.

The garment manipulator(s) 116 of the robotic system 102 can facilitate positioning or loading material(s) in preparation for and/or after the joining operations. For example, the garment can be positioned or installed on the garment loading system 126 using one or more end effector(s) on, e.g., an industrial robot or other actuator (e.g., pneumatic or servo actuators) or appropriate manipulation assembly. Industrial robots include, e.g., articulated robots, selective compliance assembly robots (SCARA), delta robots, and cartesian coordinate robots (e.g., gantry robots or x-y-z robots). Industrial robots can be programmed to carry out repetitive actions with a high degree of accuracy or can exhibit more flexibility by utilizing, e.g., machine vision and machine learning. The processed garment can also be removed from the garment loading system 126 using end effectors on an industrial robot or other manipulator or appropriate manipulation assembly. Garment manipulator(s) 116 such as, e.g., a gantry or other manipulator can also be used to control positioning of the material during processing.

The joining device 118 of the robotic system 102 facilitates joining (e.g., sewing or bonding) the reinforcing tape to the garment. The joining device 118 can include, e.g., a sewing machine or a bonding apparatus (e.g., ultrasonic welding, thermal bonding, gluing or other bonding or joining technology). For example, a double needle chain stitch sewing machine or other applicable sewing machine (e.g., a machine configured for chain stitch, lock stitch, including two needle versions of each, etc.) can be used. The joining device 118 can be configured to sew or otherwise bond or join (e.g., ultrasonic welding) material together along a path. The joining device 118 can sufficiently combine the tape and garment such that they remain connected through the intended life of the garment. A feed assembly of the joining device 118 can be used to control the feed of material through the joining device 118. For example, a feed dog of a sewing machine, a welding mechanism of an ultrasonic welder, belts, rollers or other feeding methods can be used. In addition, the joining device 118 can include a knife device (e.g., a tail knife or chain cutter) or other separation device in order to cut or sever the tape or joining medium such as, e.g., threads, stitches, materials from the processed garment, etc.

The secondary operation device(s) 120 can include stacking device(s), folding device(s), label manipulation device(s), and/or other device(s) that assist with the preparation, installation, removal and/or finishing of the processed garment.

The sensing device(s) 122 of the robotic system 102 can facilitate detecting the movement and position of the material(s) and/or inspecting the material(s) for defects and/or discrepancies during a joining operation. A sensing device 122 can comprise sensor(s) and/or camera(s) such as, but is not limited to, an RGB-D camera, IR camera, time of flight camera, Internet protocol (IP) camera, light-field camera, monorail camera, multiplane camera, rapatronic camera, stereo camera, still camera, thermal imaging camera, acoustic camera, rangefinder camera, or other vision devices.

A tape attachment module 124, when executed by the processor 104, can control the robotic system to implement attachment of the reinforcing tape across a seam of a garment. The garment loading system 126 can position the garment (e.g., a shirt) for attachment of the reinforcing tape to the garment by the joining device 118. The seam feed system 128 can be used to move and position the seam of the garment for alignment with the tape for sewing, bonding or joining.

The tape handling system 130 can control the supply of the reinforcing tape for attachment to the garment by the joining device 118. The tape handling system 130 can guide the tape to the joining device 118 for attachment across the seam of the garment. The tape handling system 130 can ensure appropriate shaping (e.g., folding of the edges) of the reinforcing tape prior to securing the tape across a seam as will be discussed.

Functioning of a garment loading system 126 will now be discussed with reference to the example of FIGS. 2A and 2B. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Figure 2A:
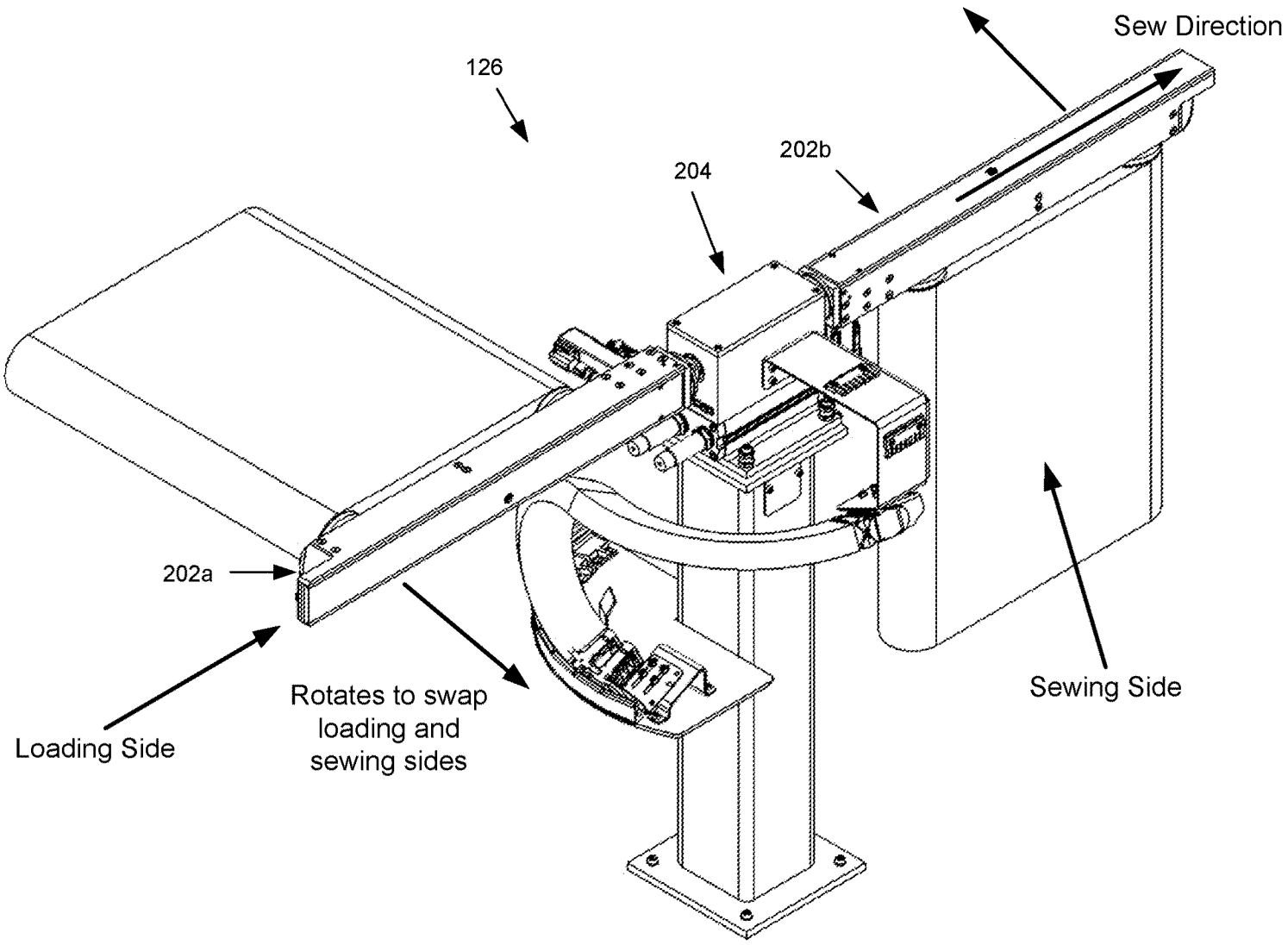
FIGS. 2A and 2B illustrate an example of a garment loading system, according to various embodiments of the present disclosure.
Figure 2B:
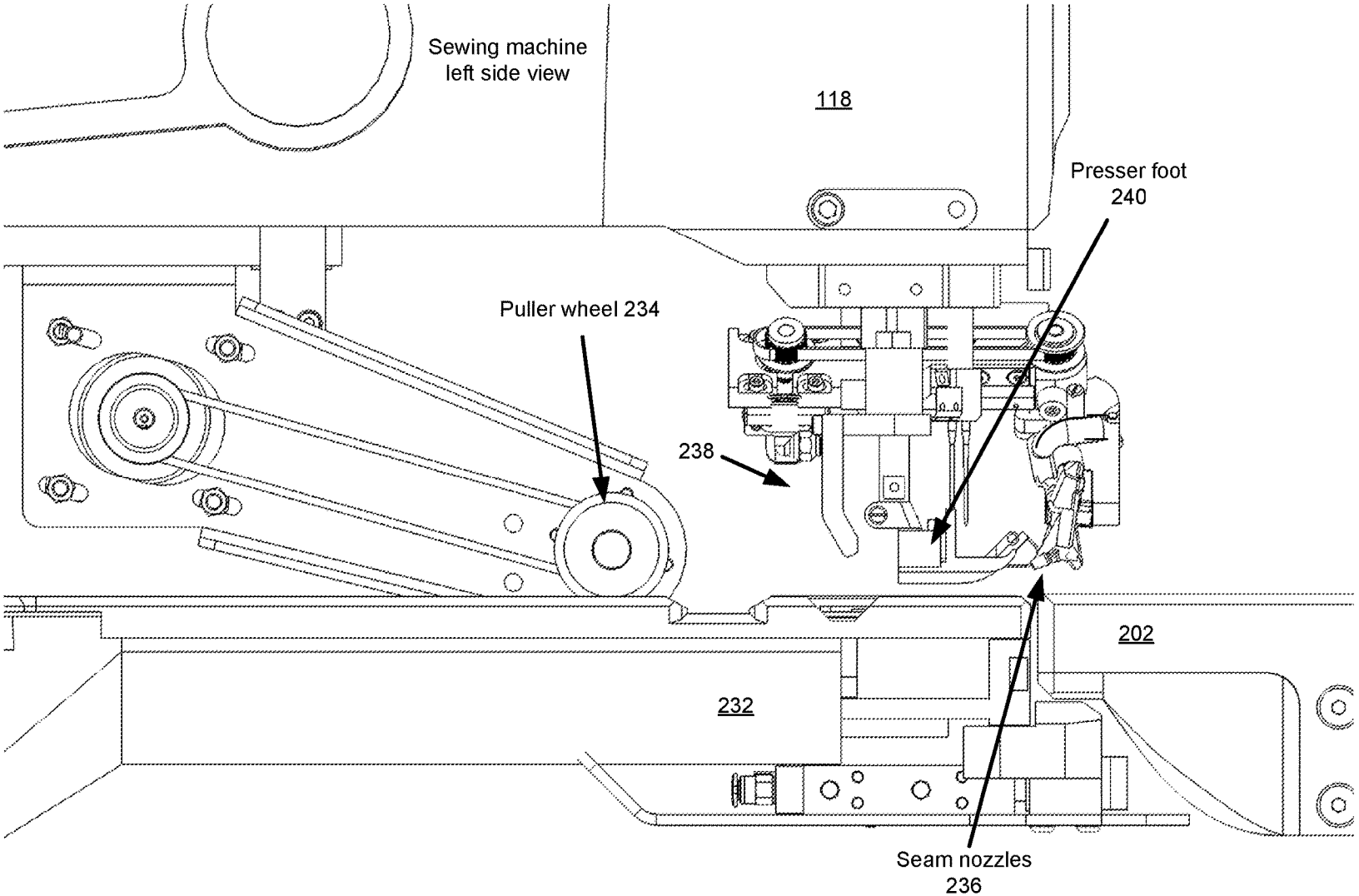

FIG. 2A illustrates an example of a garment loading system 126 that can facilitate attachment of reinforcing tape or strip of material over a seam of a garment. The garment loading system 126 comprises one or more loading arms 202 configured to hold a garment (e.g., shirt) in position for attachment of the reinforcing tape across a seam of the garment. In various embodiments, loading arms 202 can be supported by a rotary assembly 204, which is configured to rotate the loading arms 202 about a vertical axis. A loading arm 202 supporting the garment can be rotated by the rotary assembly 204 to align with the joining device 118 to facilitate attachment of the tape to the garment. The loading arms 202 can be configured with a surface (or table) over which the seam is guided. The surface can be planar, curved or contoured to facilitate the attachment of the tape to the garment. The surface can be illuminated by a light source to allow for easier tracking of the seam position. The illumination can be directed at the exposed surface of the material or can be directed through the material to facilitate location of the seam. For example, the loading arm 202 can include a translucent surface and a light source allowing the seam of the loaded garment to be illuminated (back lit) through the surface for tracking by, e.g., a vision device or sensor. In some embodiments, other forms of backlighting can be utilized.

The garment loading system 126 can comprise one or more loading arms 202 that extend radially outward from the rotary assembly 204. The rotary assembly 204 can comprise a pneumatically or electrically driven actuator configured to rotate the loading arms 202 for alignment with the joining device 118. For example, the loading arms 202 can be equally distributed about the rotary assembly 204 (e.g., two loading arms about 180 degrees apart, three loading arms about 120 degrees apart, four loading arms about 90 degrees apart, etc.). Other configurations that allow switching or flipping between the loading arms 202 (e.g., two arms separated by a fixed angle such as an L-shape) can also be used. Separation of the loading arms 202 should facilitate loading, processing and unloading of the garment. The rotary assembly 204 can be supported by, e.g., a pillar to position the loading arms 202 at the appropriate height. In some implementations, the loading arms 202 may be rotated about a longitudinal axis of the arm to facilitate loading of the garment onto the loading arm 202. In other embodiments, loading arms 202 can translate in and out of the loaded state using various motions. For example, the loading arms 202 may be linearly advanced (downward or sideways) for alignment with the joining device 118 or can be rotated is a circular fashion (similar to a revolver) for alignment with the joining device 118.

In the example of FIG. 2A, two loading arms 202 are shown extending outward in opposite directions with proximal ends of the loading arms 202 supported by the rotary assembly 204. On a loading side, a first loading arm 202*a* is available for loading a garment for processing and/or unloading a processed garment. On the sewing side, a second loading arm 202*b* is aligned with the joining device 118 for attachment of reinforcing tape to the supported garment. FIG. 2B illustrates the distal end of a loading arm 202 aligned with a free end of an attachment arm 232 of the joining device 118 (e.g., a sewing machine). The attachment arm 232 may be an integral part the joining device 118. Garment manipulator(s) 116 can be used to position the garment for attachment of the reinforcing tape over the seam. For example, an x-y-z-θ gantry system with an end effector (e.g., a friction pad interface device) can be used to position garment with respect to the joining head of the joining device 118 for application of the tape across the seam. The friction pad can contact the material of the garment to rotate and translate the garment on the loading arm 202. The gantry system can be used to feed the garment material to the joining head 238 (e.g., between a presser foot 240 and a feed dog of the sewing machine), straighten vertices (e.g., sharp changes in direction of the seam) or reduce the curvature for areas of the seam with large curvature, and remove the garment from the attachment arm 232 and back onto the loading arm 202. The gantry system may also be used to adjust the seam positioning during the attachment of the reinforcing tape over the end of the seam. The sensing device(s) 122 can provide information that can be used to identify the location of the seam and to place it in the correct position to begin the attachment process. Seam nozzles 236 can direct air jets that assist in feeding the garment material through the joining head 238 (e.g., between a presser foot 240 and a feed dog of the sewing machine) as shown in FIG. 2B. The tape handling system 130 can supply the reinforcing tape or strip of material over the seam at the joining head 238 for attachment to the garment as will be discussed.

As the reinforcing tape is affixed over the seam, the garment is advanced through the joining head 238 and onto the attachment arm 232. A puller wheel 234 can be located behind the presser foot as shown in FIG. 2B to assist in pulling the garment through the joining head 238 and onto the attachment arm 232 during the attachment process. After the reinforcing tape is attached across the garment seam, the garment can be returned to the second loading arm 202*b* and the loading arms 202 can be rotated to align the first loading arm 202*a* with the joining device 118. The garment on the first loading arm 202*a* can then be processed to add the reinforcing tape over the seam while the processed garment is removed from the second loading arm 202*b*. In some embodiments, the joining device 118 can be configured to allow the garment to be removed from the attachment arm 232 without passing back though or under the joining head 238 and/or returning to a loading arm 202. In some cases, the shape of the attachment arm 232 can be adjusted or varied before, during or after processing of the garment. For example, the attachment arm 232 can formed into sharp corner as it approaches the joining head 238 to move the material into better alignment for the processing of the shoulder of a t-shirt.

In some embodiments, the loading arm 202 can be rotated about its longitudinal axis as it moves to the loading side as shown in FIG. 2A. The rotation can facilitate loading and positioning of the garment on the loading arm 202. As the loading arm 202 and garment transition from the loading side to the sewing side, the loading arm 202 can rotate back about its longitudinal axis to position the seam of the garment for attachment of the reinforcing tape. With the loading arm 202 in this orientation, the distal end of the loading arm 202 can be aligned with the free end of the attachment arm 232 of the joining device 118 as illustrated in FIG. 2B. Garment manipulator(s) 116 can be used to advance and position the garment with respect to the joining head 238 for attachment of the reinforcing tape. Using the garment manipulator(s) 116, the garment can be shifted along the length of the loading arm 202 to feed the material into the joining device 118 and can be rotated about the loading arm 202 to align the seam with the reinforcing tape. Sensing device(s) 122 (e.g., a vision device or camera) can be used to identify the positioning of the seam and control adjustment for its alignment. In other embodiments, the garment can be manipulated using air jets, rollers, wheels, belts or combination of thereof to feed and align the garment seam for attachment of the reinforcing tape. In other embodiments, the garment may be manually adjusted on the loading arm 202 by an operator to feed the garment into the joining device 118 and align the seam for joining.

Functioning of a seam feed system 128 will now be discussed with reference to the example of FIGS. 3A and 3B. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Figure 3A:
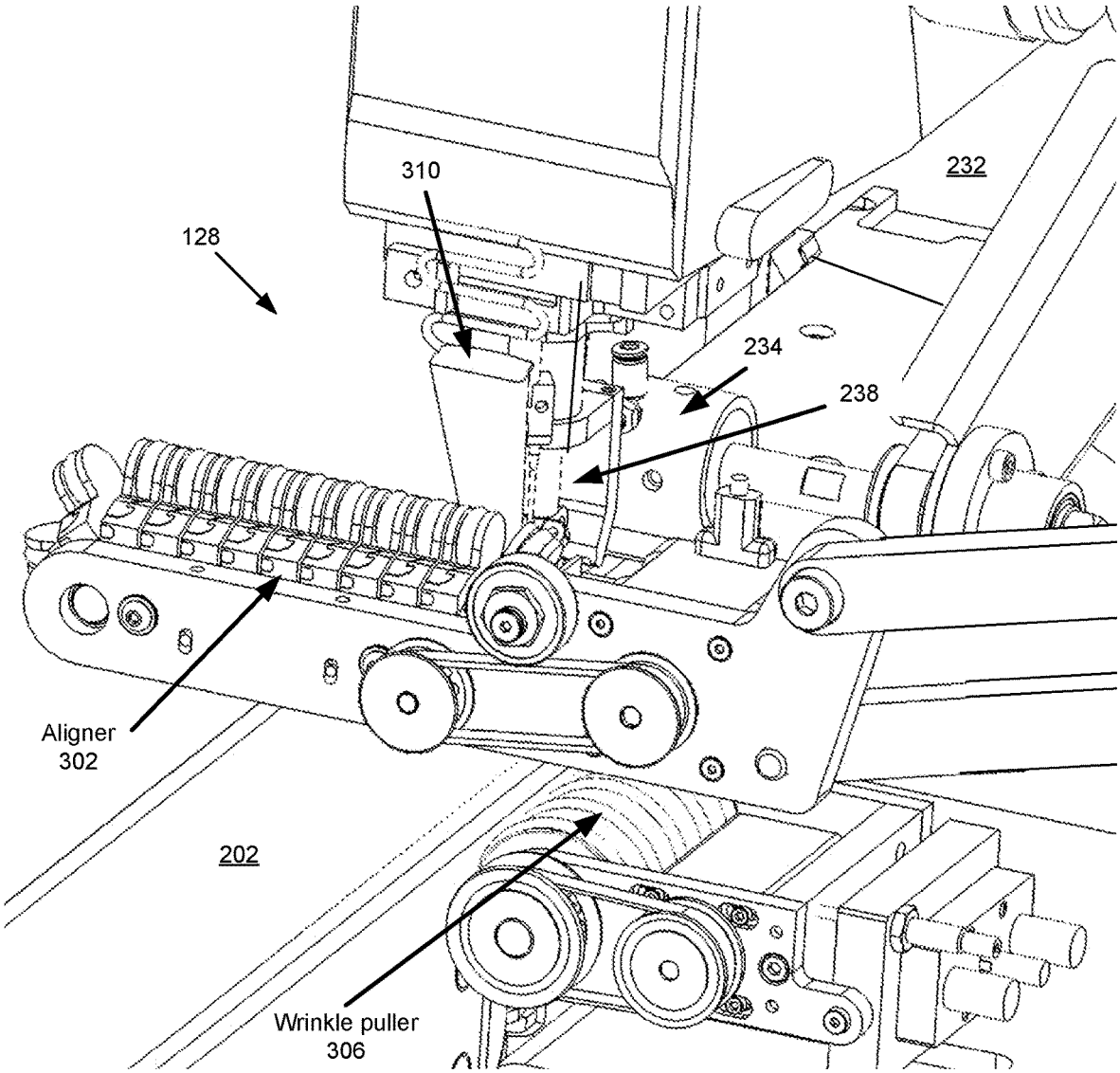
FIGS. 3A and 3B illustrate an example of a seam feed system, according to various embodiments of the present disclosure.
Figure 3B:
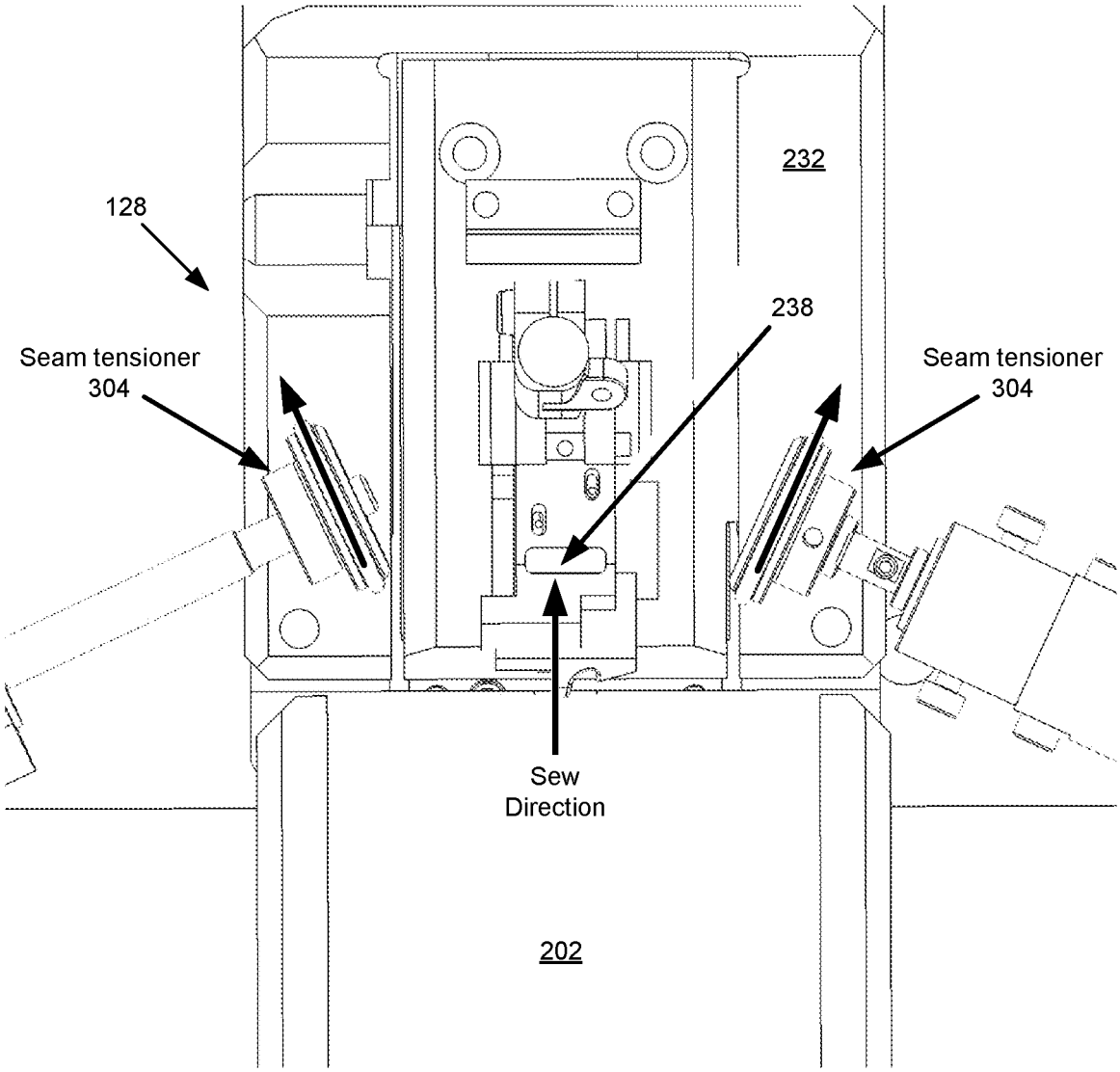

FIGS. 3A and 3B illustrate an example of a seam feed system 128 that can facilitate attachment of reinforcing tape across a seam of a garment. The seam feed system 128 comprises components that enable control of the garment and alignment of the seam during attachment of the reinforcing tape. For example, the seam feed system 128 can comprise one or more fabric manipulator(s) such as, e.g., ply aligner(s) 302, seam tensioner(s) 304, wrinkle puller(s) 306 and/or other manipulator configured for manipulation of the garment material during attachment of the reinforcing tape. FIG. 3A illustrates the use of a ply aligner 302 for adjustment of the seam position on the surface of the loading arm 202, seam tensioners 304 on opposite sides of the joining head 238 for placing a portion of the seam under tension during the joining process, and wrinkle puller 306 for pulling the garment material flat and to remove wrinkles.

A garment loaded on the loading arm 202 can be advanced along the length of the loading arm 202 to feed the garment into position with respect to the joining head 238. With the seam located on top of the surface of the loading arm 202, the garment material can be advanced (e.g., by an operator or garment manipulator(s) 116) over the attachment arm 232 and into the joining head 238 (e.g., between a presser foot 240 and a feed dog of the sewing machine). The seam nozzles 236 (FIG. 2B) can direct jets of air to assist in feeding the garment material through the joining head 238. The joining head 238 can be configured to secure and feed the garment material through the joining device 118. The seam nozzles 236 can also be configured to ensure that the seam is folded in a specified direction. For example, the seam nozzles 236 can direct an air jet perpendicular to (or substantially perpendicular to) the sew or feed direction to blow the seam over in the preferred direction. In other embodiments, a blade or other flattening device can be used to fold the seam in the desired direction. Other methods can utilize rollers or wheels to fold the seam before attaching the reinforcing tape, or use tape to hold the seam down before attaching the reinforcing tape or stitch the seam in position before attaching the reinforcing tape.

With the seam of the garment held in position with respect to the joining head 238, the garment can be stretched to straighten and align the seam along the feed direction. A garment manipulator 116 (e.g., a friction pad interface device) can be used to contact the garment and stretch the material away from the joining head 238. Using the garment manipulator 116, the friction pad can be positioned to contact the material of the garment adjacent to the seam and stretch the garment along the loading arm 202. The friction pad can contact the material, e.g., adjacent to a distal end of the seam or a short distance upstream of the sewing head. In some implementations, contact is provided at a first location initially and then adjusted after a defined processing period. In other embodiments, a turning wheel can be positioned on or against the garment over the loading arm 202 to stretch the material along the feed direction. The tension applied to the material along the feed direction can reduce or remove the effective curvature in the seam. This action can stretch the seam for better alignment with the feed head 238 and can reduce or remove the effective curvature in the desired path of attachment at any point along the seam as needed. This action may be used for areas of high curvature but may not be needed or utilized along low curvature sections of the seam. For example, many seams are straight or have a low curvature at the start of the seam but can include one or more areas of high curvature along its length.

With the seam of the garment in position, the ply aligner 302, seam tensioner(s) 304, wrinkle puller 306 and/or other fabric manipulator(s) can be advanced to contact the garment material on the loading arm 202. The garment manipulator 116 can maintain contact with the material as the reinforcing tape is attached over the seam or can be retracted to release the seam after the ply aligner 302 is positioned on the garment material. Garment manipulator(s) 116 such as, e.g., a gantry or other manipulator can also be used to control positioning of the material during processing. For example, one or more gantry or other manipulator can be used to steer the garment or material during processing instead of using ply aligners. Vision feedback can be used to control steering of the garment.

The seam feed system 128 can maintain proper alignment of the seam with the joining head 238 and reinforcing tape during sewing, bonding or joining. Alignment of the seam with the joining head 238 can be accomplished using a fabric manipulator such as, e.g., a ply aligner 302, which can provide fine guidance of the garment seam near the joining device 118. Ply aligners 302 provide traction in one direction to control positioning of the material in that direction, while concurrently allowing movement of the material in a perpendicular direction. For example, the ply aligner 302 can comprise a series of rollers that operate as idlers in the feed direction of the joining device 118, while providing controlled movement of the garment material. In the example of FIG. 3A, movement of the rollers about the ply aligner 302 can shift the material from side-to-side on the surface of the loading arm 202 to keep the seam of the garment opening substantially aligned with the joining head 238, and thus the reinforcing tape, during the joining (e.g., sewing or bonding) process.

Positioning of the fabric manipulator, e.g., the ply aligner 302 against the material on the surface of the loading arm 202 or away from the loading arm 202 can be provided by pneumatic, servo, or other appropriate actuator. As illustrated in FIG. 3A, the ply aligner 302 can be moved (e.g., rotated) away from the surface of the loading arm 202 to allow for rotation of the garment loading system 126 for removal of a processed garment and alignment of a loading arm 202 with the attachment arm 232 of the joining device 118. The ply aligner 302 can be positioned on the garment material and seam after the garment has been aligned with (and inserted into) the joining head 238 of the joining device 118. Adjustment of the seam position can be controlled by the ply aligner 302 to ensure proper alignment with the reinforcing tape during attachment. The ply aligner 302 can keep the seam appropriately aligned with the presser foot 240 and/or joining head 238. Positioning by the ply aligner 302 can be controlled based upon feedback from one or more sensing device(s) 122. For example, the seam position can be monitored or tracked by a camera or other appropriate vision device or sensor and used to control adjustment of the seam position in real time or near real time.

The ply aligner 302 can include, but is not limited to, omni-chain material aligners or omni-belt material aligners. An omni-chain material aligner can comprise a circular roller chain extending between two or more sprockets. The rollers of the circular roller chain can provide rolling contact in the feed direction while providing traction in a substantially perpendicular direction. The sprockets can be driven by a motor (e.g., a servomotor or stepper motor) to perform active steering control of the material. FIG. 3A illustrates an example of omni-belt material aligner comprising a belt (e.g., an indexed belt, chain, etc.) with attached perpendicular rollers, which allow movement of the material in the feed direction and active motorized steering control of the material. In FIG. 3A, the rollers are offset from the belt to provide contact with the garment material. Additional details about material aligners are provided in U.S. patent application Ser. No. 16/984,815, entitled "Material Aligner" and filed on Aug. 4, 2020, which is hereby incorporated by reference in its entirety. In other embodiments, an omni-wheel which can be driven in two directions may be used to provide control of the garment material being fed into the joining head. In some embodiments, a contact surface similar to a feed dog can be used to temporarily contact and shift the sleeve and/or garment material substantially perpendicular to the feed direction of the joining head.

The seam feed system 128 can include seam tensioner(s) 304 to facilitate attachment of the reinforcing tape or strip of material across the seam of the garment. As shown in FIG. 3A, seam tensioners 304 can be located on opposite sides of the joining head 238 for placing the seam under tension during the joining process. This can flatten out the seam right before the presser foot 240 and/or joining head 238 to facilitate smooth attachment of the tape. By placing the seam under a controlled tension, the garment material can be smoothed and any wrinkles that may be present can be removed. In addition, tensioning of the seam can help provide a uniform attachment of the reinforcing tape and a smoother finished appearance of the garment. The seam tensioners 304 can be positioned at an angle with respect to the feed direction along the attachment arm 232, for example in a range from about 10 degrees to about 80 degrees, about 10 degrees to about 50 degrees, from about 20 degrees to about 40 degrees or at an angle of about 30 degrees.

The seam tensioners 304 can be moved (e.g., pivoted or rotated) away from the attachment arm 232 to provide access for loading the garment for processing. After the garment has been aligned with (and inserted into) the joining head 238 of the joining device 118, the seam tensioners 304 can be positioned to contact the garment material adjacent to the joining head 238. This may be better understood from the top view of FIG. 3B, which illustrates the relationship between the loading arm 202, attachment arm 232, joining head 238 and seam tensioners 304. As can be seen, the seam tensioners 304 are located on opposite sides of the joining head 238 with their contacting surfaces (e.g., wheels or rollers) at an angle of, e.g., about 30 degrees with respect to the sew direction. When the seam tensioners 304 are driven at this angle, tension applied to the material can be considered to be as sum of two tensions in a first direction along the sewing or feed direction away from the seam and in a second direction perpendicular to the sewing or feed direction. The tension in the second direction perpendicular to the sewing of feed direction can ensure that a seam (e.g., an overlock seam) is spread flat prior to attaching the reinforcing tape. The tension may be controlled by controlling the contact pressure of the seam tensioners 304, their angle, and/or their driven rotational speed. In some embodiments, the seam tensioners 304 can utilize non-driven or passive contacting surfaces to tension the seam during attachment of the reinforcing tape. In other implementations, air jets can be used to smooth and tension the material during attachment of the reinforcing tape or strip of material. Air nozzles can be configured to direct jets across the garment material to prevent or reduce wrinkles that may be present. Air jets blowing in opposite directions can also tension the seam during the joining process.

The seam feed system 128 can also include one or more wrinkle puller(s) 306 for removing wrinkles from the garment during the tape attachment process. The wrinkle puller 306 can include one or more contacting surfaces (e.g., wheels or rollers) that can be advanced to contact the garment material on the loading arm 202 as illustrated in FIGS. 3A and 3B. By controlling the contact pressure of the wrinkle puller 306 and/or its rotational speed, the tension or pull applied to the garment material can be controlled. In other embodiments, the wrinkle puller 306 can comprise a mechanical gripper or friction pad interface device that can be controlled to contact the material and tension the garment material.

Initially, the wrinkle puller 306 is retracted away from the loading arm 202 to allow the garment to be loaded into the joining device 118 as previously discussed. Once the garment is loaded, the wrinkle puller 306 can be advanced to contact the material on the loading arm 202. Movement of the wrinkle puller 306 can be coordinated with the movement of the ply aligner 302. Where the garment has been stretched by the garment manipulator 116 (e.g., a friction pad interface device) away from the joining head 238, the wrinkle puller 306 can be advanced and controlled to remove or reduce wrinkles produced by the stretching. The ply aligner 302 can then be positioned on the smoothed garment material. In other implementations, the wrinkle puller 306 and ply aligner 302 can be simultaneously advanced to contact the garment. As previously described, the ply aligner 302 can adjust positioning of the seam for attachment of the reinforcing tape or strip of material. The wrinkle puller 306 can also assist with the alignment by tensioning the garment material to remove or reduce curvatures in the seam (e.g., around the collar of a shirt). By applying tension perpendicular to the seam, the shape can be changed to avoid distortions from going through the joining device 118. For example, the wrinkle puller 306 can be used during handling of vertices or during the sewing of the reinforcing tape along a curve. The wrinkle puller 306 can provide a controlled force to straighten out the garment at vertices without providing too much tension of the material. On a curve, the wrinkle puller 306 can tension the material to assist in reducing or removing a wrinkle at the curve.

Feedback can be used to control the operation of the garment manipulator(s) 116, ply aligner(s) 302, seam tensioner(s) 304. wrinkle puller(s) 306 and/or other fabric manipulator(s) for attachment of the reinforcing tape to the garment. The sensing device(s) 122 can provide feedback information that can be used to track the seam position for attachment of the reinforcing tape. For example, vision devices such as cameras can be used to monitor the position of the seam being feed into the joining head 238. The vison devices can also be used to detect seam curvature or seam intersections, and/or start and stop points. Other types of sensors such as optical sensors, physical sensors, laser sensors, etc. can also be used to track the seam position and provide feedback for control of the ply aligner 302, seam tensioners 304 and/or wrinkle remover 306.

Functioning of a tape handling system 130 will now be discussed with reference to the example of FIGS. 4A-4C. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Figure 4A:
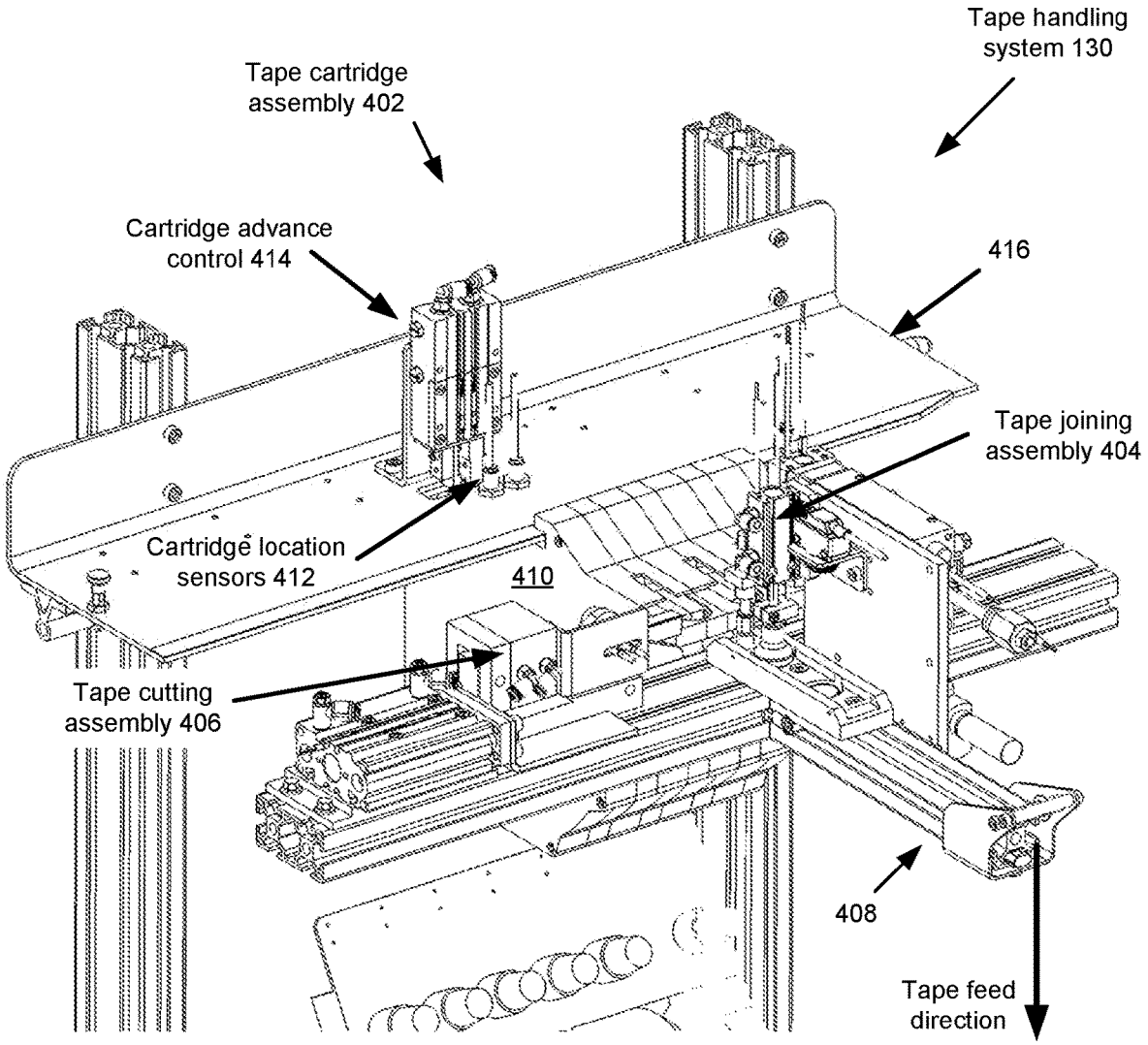
FIGS. 4A-4F illustrates an example of a tape handling system, according to various embodiments of the present disclosure.
Figure 4B:
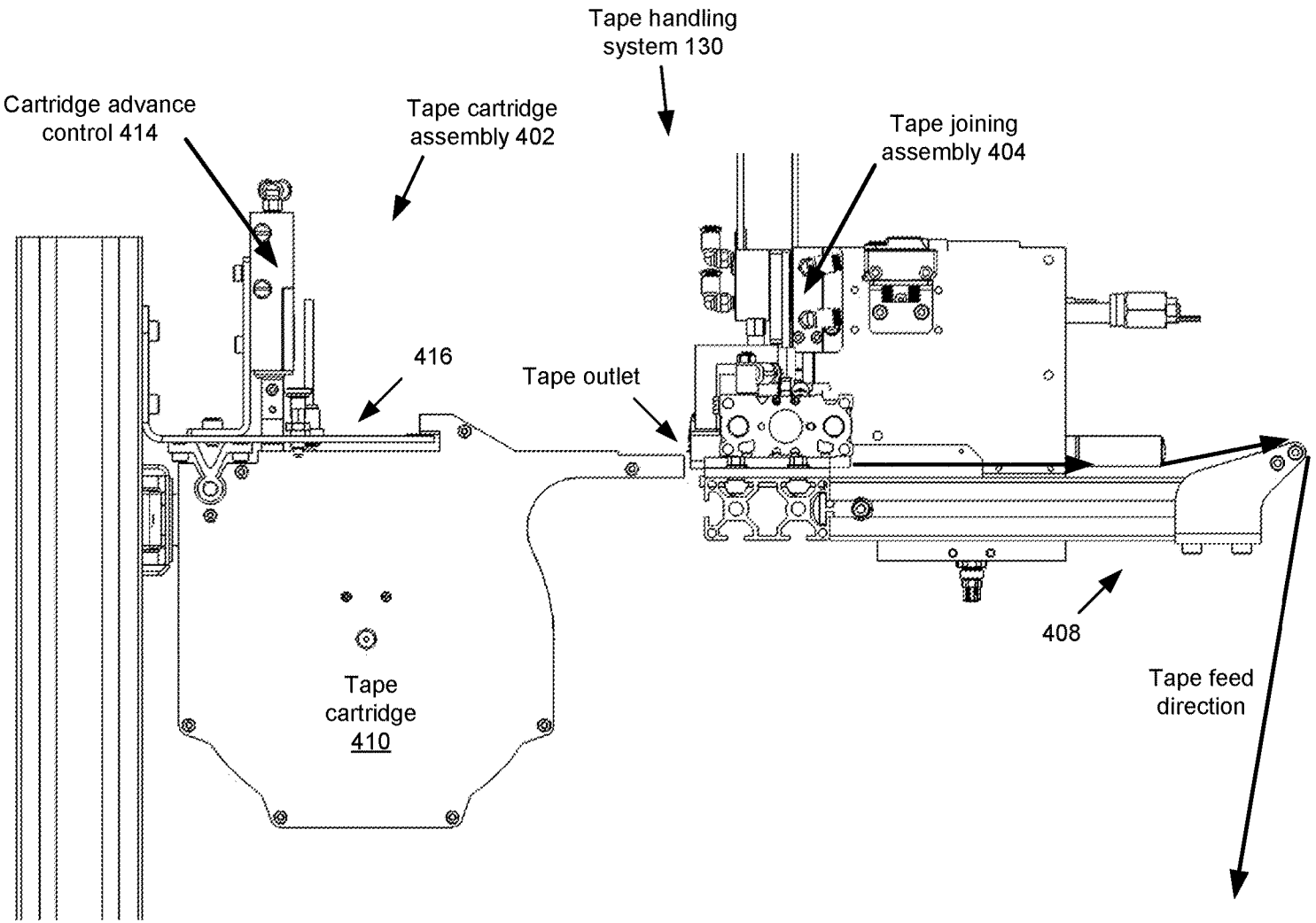
Figure 4C:
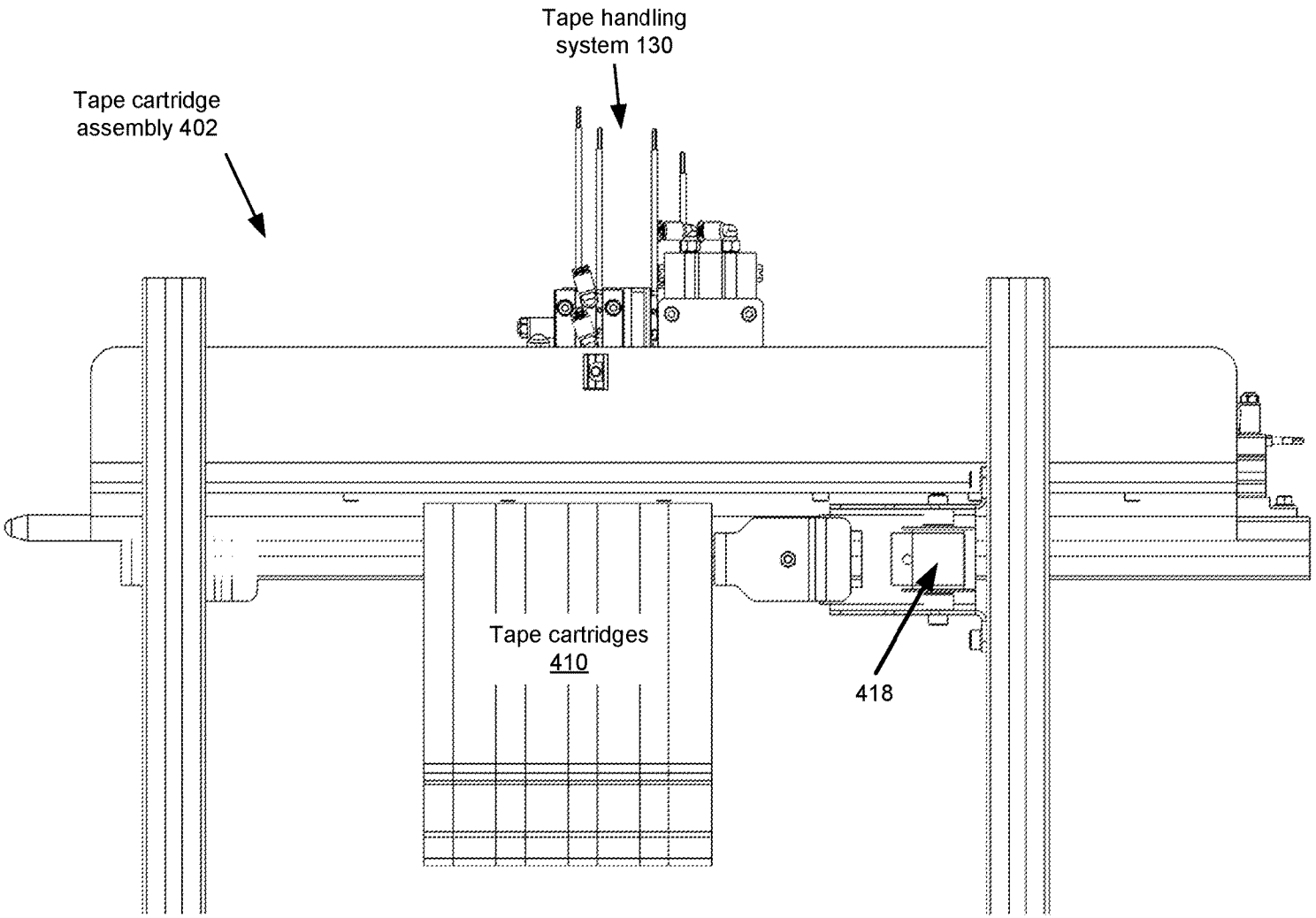

FIGS. 4A-4C illustrate an example of a tape handling system 130 that can be included to facilitate attachment of reinforcing tape or strip of material over a seam of a garment by a joining device 118. The tape handling system 130 can comprise, e.g., a tape cartridge assembly 402, a tape joining assembly 404 and a tape cutting assembly 406. The tape handling system 130 can also include components configured to guide the reinforcing tape to the joining head 238 for attachment to the garment. The reinforcing tape being dispensed by the tape handling system 130 can be folded prior to being attached over the seam. For example, a folding guide 310 (FIG. 3A) can be provided that rolls the unfinished edges of the reinforcing tape or strip of material under prior to being feed to the joining head 238. The folding guide 310 can be located adjacent to the joining head 238 and configured to receive the unfolded reinforcing tape and provide the folded tape to the joining head 238. In other implementations, air jets can be used to fold the edges of the reinforcing tape as it is supplied to the joining head 238. In other implementations, the reinforcing tape may be pre-folded.

The tape handling system 130 can guide the reinforcing tape or strip of material dispensed from a cartridge or roll to the joining head 238 where it is attached to the garment. As the reinforcing tape is fed off the cartridge or roll, it can pass through a tape joining assembly 404 before being guided to the joining head 238 for attachment over the garment seam. A tape guide 408 can direct the reinforcing tape out of the tape joining assembly 404 to the joining head. For example, the reinforcing tape can pass over the joining device 118 and down to the joining head 238 as illustrated in FIGS. 4A and 4B. In other implementations, the reinforcing tape can be fed from below instead of over the joining device 118. For example, the tape can be guided to align across the seam under the material before attachment. The tape guide 408 can hold the reinforcing tape in a fixed orientation with respect to the joining head 238 to facilitate alignment of the seam of the garment with the reinforcing tape. As discussed, the reinforcing tape can be folded by, e.g., a folding guide prior to being attached over the seam. The folding guide can fold the edges of the reinforcing tape or material using a physical guide and/or air jets before attachment by the joining head 238.

Referring to FIG. 4A, shown is an example of a tape handling system 130 including a tape cartridge assembly 402 comprising one or more tape cartridges (or magazines) 410 that can hold a spool or roll of reinforcing tape or strip of material. The tape cartridge(s) 410 can include a housing configured to enclose the spool or roll of reinforcing tape or material with a tape outlet (or opening) through which the tape or strip of material is dispensed or extracted. The spool or roll of reinforcing tape or material can include an extended length of continuous material (e.g., 40 yards) or can include a plurality of spools or rolls of shorter length within cartridges 410. In other embodiments, the tape cartridges (or magazines) 410 can comprise a stack of reinforcing tape or strip of material that can be dispensed or extracted for attachment. For example, the reinforcing tape or strip of material can be folded in a stack for dispensing form the cartridge (or magazine). The amount of remaining reinforcing tape or strip of material can be monitored as it is dispensed and consumed. For example, a sensor in the cartridge 410 can detect when the diameter of the spool or roll of tape or material (or the height of the stack) falls below a certain point. In some embodiments, a sensor may be used to help determine the end of the roll. In other embodiments, the number of revolutions of the roll of tape or material can be monitored to determine when the end is approaching. In some embodiments, the tape or material can include a marker imbedded a defined distance from the end of the tape. A sensor (e.g., adjacent to the tape outlet) can detect the marker as it passes, indicating proximity to the end of the roll. In other embodiments, a sensor can detect the end of the reinforcement tape after it has left the roll.

In the example of FIG. 4A, the tape cartridges 410 can be supported by a horizontal beam 416 or other support structure. Positioning of the tape cartridges 410 with respect to the tape guide 408 can be controlled using, e.g., cartridge location sensors 412 and cartridge advance control 414. The tape outlet of the tape cartridge 410 can be positioned to align with the tape guide 408 so that, as the reinforcing tape or strip of material extends from the tape outlet (either manually or in an automated fashion), the tape is guided from the roll or cartridge 410 into the tape guide 408 and thus to the joining head 238.

A tape joining assembly 404 can be located at the inlet of the tape guide 408 adjacent to the tape outlet of the tape cartridge 410 as illustrated in FIG. 4A, or other appropriate location for joining of the tape or strip ends. The reinforcing tape or strip of material can extend from the tape outlet (or opening) through the tape joining assembly 404 and along the tape guide 408. The tape joining assembly 404 can be configured to join ends of reinforcing tapes or strips of material using, e.g., adhesives, adhesive tape, or other appropriate bonding or joining scheme. The tape joining assembly 404 can be pneumatically or electrically operated to join the beginning of a new roll (or stack) of tape or material to the end of the existing roll by, e.g., contact pressure or bonding of the two ends.

When the end of an existing cartridge or roll (or stack) of tape is approaching, the joining process can be paused and the tape joining assembly 404 can secure the reinforcing tape or strip of material passing through the assembly in position during attachment of the new reinforcing tape. For example, the tape joining assembly 404 can include, e.g., a solenoid or pneumatic cylinder that can apply a clamping force on the reinforcing tape or strip of material to secure it in place. With the tape or strip extending between the cartridge 410 and the tape joining assembly 404, a tape cutting assembly 406 can cut the tape to release the roll or cartridge 410. The tape cutting assembly 406 can include a shear or knife device or other separation device configured to cut or sever the reinforcing tape or strip of material. As shown in FIG. 4A, the tape cutting assembly 406 can be automatically advanced along a rail to allow the knife device to engage with and sever the tape or material, before being retracted again. The tape cutting assembly 406 can then be advanced and retracted using pneumatic, electric or other appropriate actuator.

The used roll or cartridge 410 can then be replaced such that the tape outlet of the new cartridge is aligned with the tape joining assembly 404. The roll or cartridge 410 can be replaced manually by a user or can be replaced in an automated fashion. The new reinforcing tape or strip of material can be extended to the tape joining assembly 404 so that the beginning of the new tape or strip aligns or overlaps with the end of the used reinforcing tape or material secured in the tape joining assembly 404. For example, the roll or cartridge 410 can be driven to advance the tape or strip of material. In various embodiments, a tape transport assembly can use an actuator to transport the beginning of the tape or strip of material from the tape outlet to the tape joining assembly 404 as discussed with respect to FIGS. 4D-4F. With the ends of the tapes or strips aligned, tape joining assembly 404 can then bond the ends of the tapes or material together. Once the new reinforcing tape or strip of material is attached, the tape joining assembly 404 can release the tape and the attachment process can continue again.

FIG. 4B is a side view illustrating the relationship between the roll or cartridge 410, the tape joining assembly 404 and the tape guide 408. As shown, the tape cartridges 410 can be supported by the beam 416. The reinforcing tape or strip of material can extend from the tape outlet, through the tape joining assembly 404 and along the tape guide 408 before being directed to the joining head 238.

Referring back to FIG. 4A, a plurality of tape cartridges 410 can be provided for automatic loading of reinforcing tape or strips of material for attachment over seams of garments. In the example of FIG. 4A, the tape cartridges 410 are loaded on the horizontal beam 416. Other support structures can also be used. For example, a revolving system can be configured to support a plurality of the tape cartridges 410 that can be rotated into position as necessary. In other embodiments, a vertical beam can be configured to support the tape cartridges 410 in a vertical orientation. In FIG. 4A, a current tape cartridge 410 supplies the reinforcing tape or material through the tape joining assembly 404 and along the tape guide 408 as previously described. As the current spool or roll (or stack) of tape nears its end, the attachment process can be paused to allow a new spool or roll (or stack) of tape to be automatically attached. In some implementations, the attachment process can be paused between garments to allow the new spool or roll (or stack) of tape to be attached. The new spool or roll (or stack) of tape can be attached at a location that allows the seam to be covered by a continuous strip of tape.

The tape joining assembly 404 can secure the end of the tape in position allowing the tape cutting assembly 406 to separate the secured portion of the tape or material from the tape cartridge 410. In the case of a single or last tape cartridge 410, the cartridge or cartridges can be removed from the beam 416 and replaced by one or more new cartridge(s) 410. In alternate embodiments, the tape cartridge assembly 402 can be configured for FIFO operation, allowing used tape cartridges 410 to be removed and new tape cartridges 410 to added as needed. Where another tape cartridge 410 is available on the beam 416, the tape handling system 402 can automatically advance the new cartridge 410 into position for use. Cartridge location sensor(s) 412 such as, e.g., proximity or magnetic sensors can be used to detect the position of the tape cartridge(s) 410. For example, a first sensor can detect when a tape cartridge is in position to dispense the reinforcing tape or material and a second sensor can detect if another tape cartridge 410 is available for use.

A cartridge advance control 414 can be configured to control the movement of the tape cartridges 410 to advance an unused spool or roll (or stack) of reinforcing tape or strip of material to use. For example, pins can extend downward through the beam 416 to engage with the tape cartridges 410 to control their movement. A first pin can extend through the beam 416 to hold the current tape cartridge 410 in position. When the spool or roll (or stack) of reinforcing tape or material is ready to change out, a second pin can then be extended to allow the spent tape cartridge 410 to advance by a fixed amount when the first pin is retracted and allow the next cartridge to advance into position to supply reinforcing tape or material. In this way, the tape cartridges 410 can be advanced in sequence to supply the needed tape. The advancing force can be provided by, e.g., a constant force spring 418 as shown in FIG. 4C, or other tensioning mechanism. In other implementations, the advancement of the tape cartridges 410 can be controlled using, e.g., pneumatic or electric actuators or can be gravity feed. In some embodiments, the advancement can be accomplished with e.g. a position-controlled servo motor, potentially eliminating the need for e.g. a pin and sensor system to control the cartridge advancement. As has been described, the reinforcing tape or strip of material can be advanced and coupled to the severed tape or material by the tape joining assembly 404. Once connected, the tape cartridge 410 can resume the process to attach the tape or material over the seam of the garment.

Figure 4D:
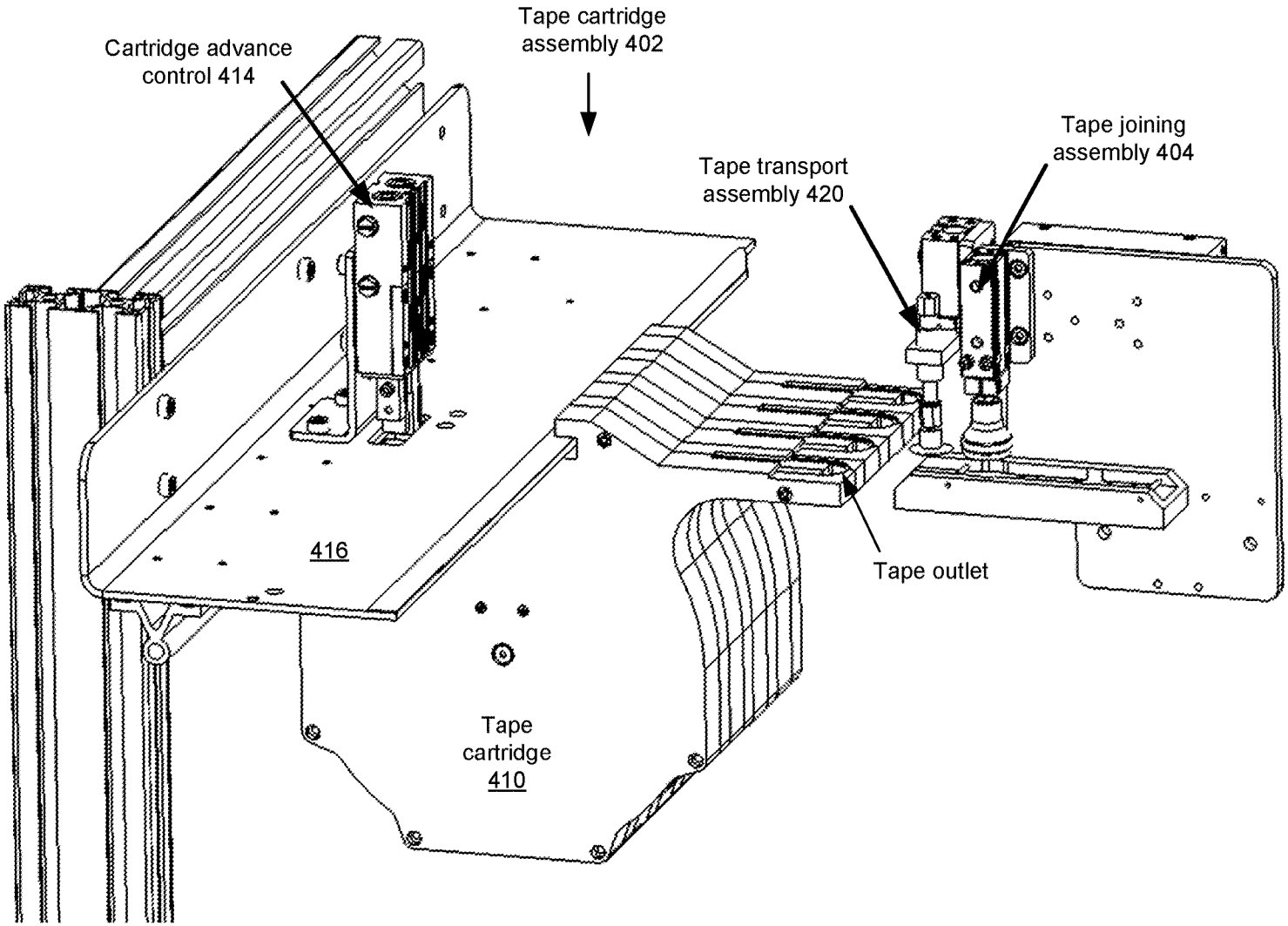
Figure 4E:
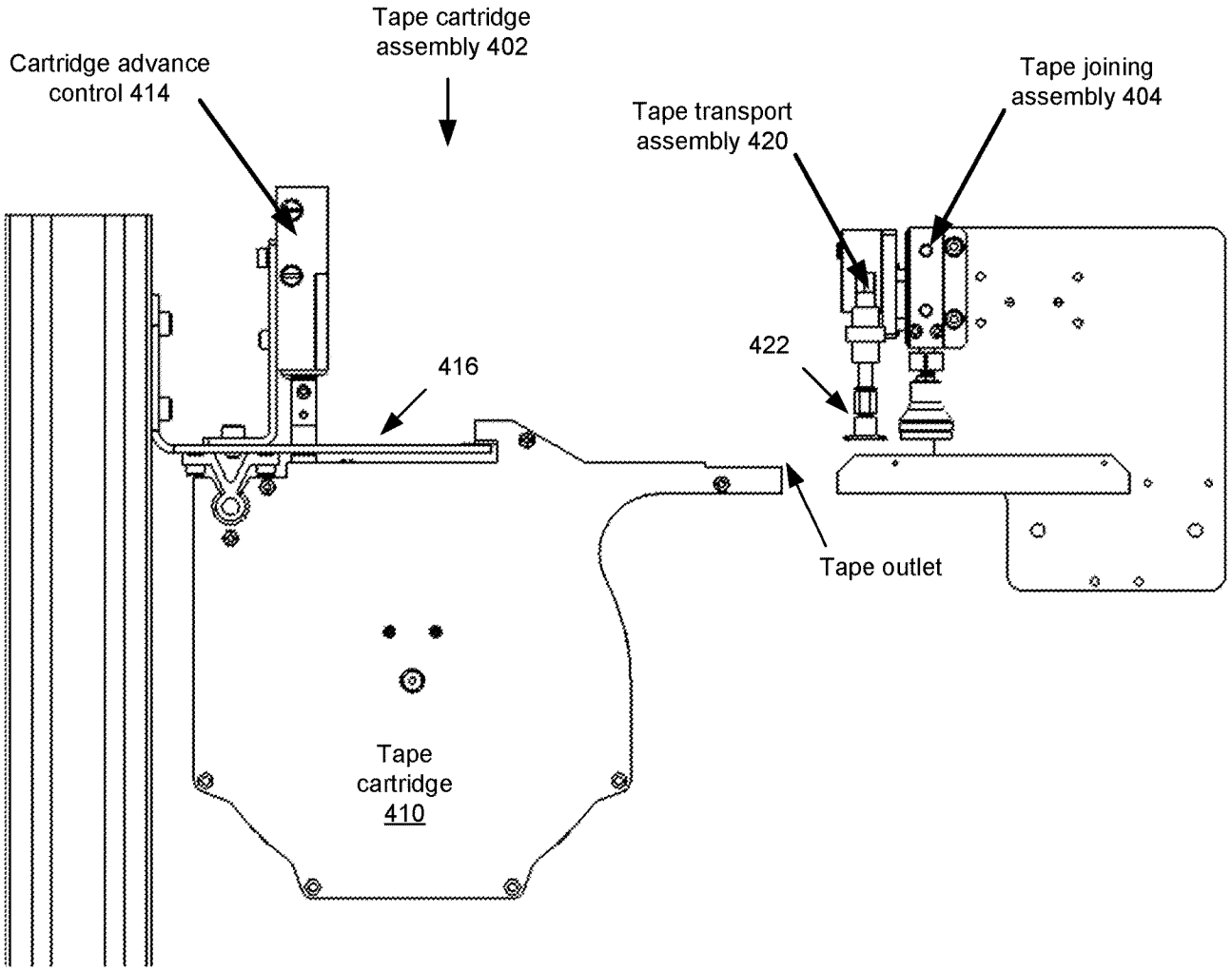
Figure 4F:
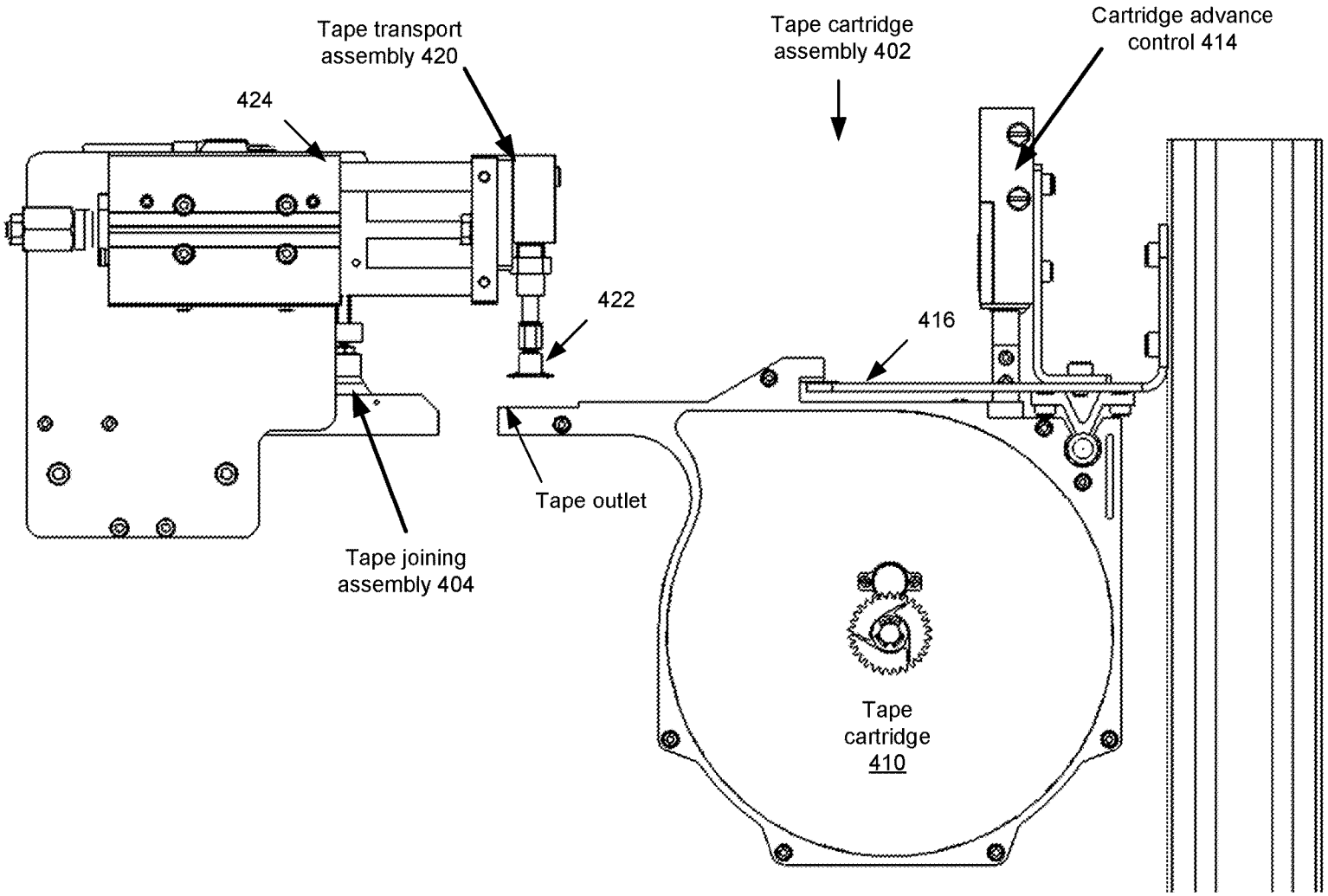

Referring now to FIGS. 4D-4F, the tape handling system 130 can comprise a tape transport assembly 420 that can use an actuator to transport the beginning of the tape or strip of material from the tape outlet of the new tape cartridge to the tape joining assembly 404. As shown in the example of FIG. 4D, the tape transport assembly 420 can be located adjacent to the tape joining assembly 404 to facilitate positioning of the beginning of the new reinforcing tape or strip of material joining with the end of the existing tape or strip of material secured by the tape joining assembly 404. When the end of an existing cartridge or roll (or stack) of tape is approaching, the joining process can be paused and the tape joining assembly 404 can secure the reinforcing tape or strip of material passing through the assembly in position during attachment of the new reinforcing tape. For example, the tape joining assembly 404 can include, e.g., a solenoid or pneumatic cylinder that can apply a clamping force on the reinforcing tape or strip of material to secure it in place. With the existing tape or strip extending between the cartridge 410 and the tape joining assembly 404, a tape cutting assembly 406 can cut the tape to release the roll or cartridge 410 as illustrated in FIG. 4A. In some cases, the tape may be advanced to a desired point where cutting is not needed. The used roll or cartridge 410 can then be replaced such that the tape outlet of the new cartridge 410 is aligned with the tape joining assembly 404 as shown in FIG. 4D. The beginning of reinforcing tape or strip of material can be releasably affixed to the tape outlet of the new tape cartridge 410 mechanically or by using, e.g., adhesives, adhesive tape, or other appropriate bonding or joining scheme.

FIGS. 4E and 4F are side views illustrating an example of the relationship between the tape joining assembly 404 and the tape transport assembly 420. The tape transport assembly 420 can comprise a gripping device 422 configured to grip the beginning of the tape or strip of material for transport to the tape joining assembly 404 and an actuator 424 configured to control movement of the gripping device 422. The actuator 424 can comprise one or more linear actuators or other appropriate actuators as can be understood. The gripping device 422 can including a gripping surface that contacts the beginning of the reinforcing tape or strip of material for transport. For instance, the gripping device 422 can utilize a vacuum or other appropriate gripping action to secure the beginning of the tape or strip of material against the gripping surface. The vacuum can be sufficient to allow the gripping device 422 to lift the beginning of the tape or strip of material from the tape outlet and hold the tape or strip as it is advanced to the tape joining assembly 404. In other embodiments, the tape or strip of material can be mechanically gripped by the gripping device 422.

FIG. 4D shows the gripping device 422 initially positioned next to the tape joining assembly 404 with the gripping device 422 raised over the end of the existing tape or strip of material. When the existing tape cartridge 410 is ready for replacement, the tape joining assembly 404 can be lowered as illustrated in FIG. 4F to secure the reinforcing tape or strip of material passing through the assembly in position, then the next tape cartridge 410 can be advanced as described. With tape outlet aligned, the actuator 424 can advance the gripping device 422 to position the gripping surface over the beginning of the new tape or strip of material at the tape outlet as shown in FIG. 4F. The gripping device 422 can then be lowered to grip the beginning of the tape or strip of material. To ensure that the position of the beginning of the reinforcing tape or strip of material is maintained during handling and operation, it can be affixed to the tape cartridge 410 at the tape outlet mechanically or by using a releasable adhesive, tape or other bonding or joining scheme. The vacuum or other gripping action can provide sufficient strength to allow the beginning of the tape or strip of material to be separated from the tape outlet as the gripping device 422 is raised. The gripping device 422 can be configured to separate the tape or strip of material with the adhesive, tape, etc. still affixed to the tape or strip of material. The adhesives, adhesive tape, or other appropriate bonding or joining can then be used to secure the beginning of the new tape or strip of material to the end of the existing tape or strip of material.

With the gripping device 422 holding the beginning of the tape or strip of material from the new tape cartridge 410, the actuator 424 can retract the gripping device 422 adjacent to the tape joining assembly 404 as shown in FIG. 4D, positioning the beginning of the new tape or strip of material over the end of the existing tape or strip of material. The gripping device 422 can then be lowered to attach the beginning and end together. The adhesives, adhesive tape, or other appropriate bonding or joining on the new tape or strip of material can be used to secure the beginning and end together or additional adhesive, tape or bonding can be added. The gripping device 422 can be pneumatically or electrically operated to apply a force or pressure to assist in securing the two tapes or strips of material together. The vacuum can then be released and the gripping device 422 raised away from the tapes for operational clearance. Once the new reinforcing tape or strip of material is attached, the tape joining assembly 404 can release the reinforcing tape or material and the attachment process can be initiated again. In some implementations, the connected tape or strip of material can be advanced to allow the tape joining assembly to further attach the tapes or strips together. For example, the tape joining assembly 404 can be pneumatically or electrically operated apply additional contact pressure or bonding of the two ends.

Functioning of the tape attachment module 124 of the robotic system 102 will now be explained with reference to FIG. 5. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Figure 5:
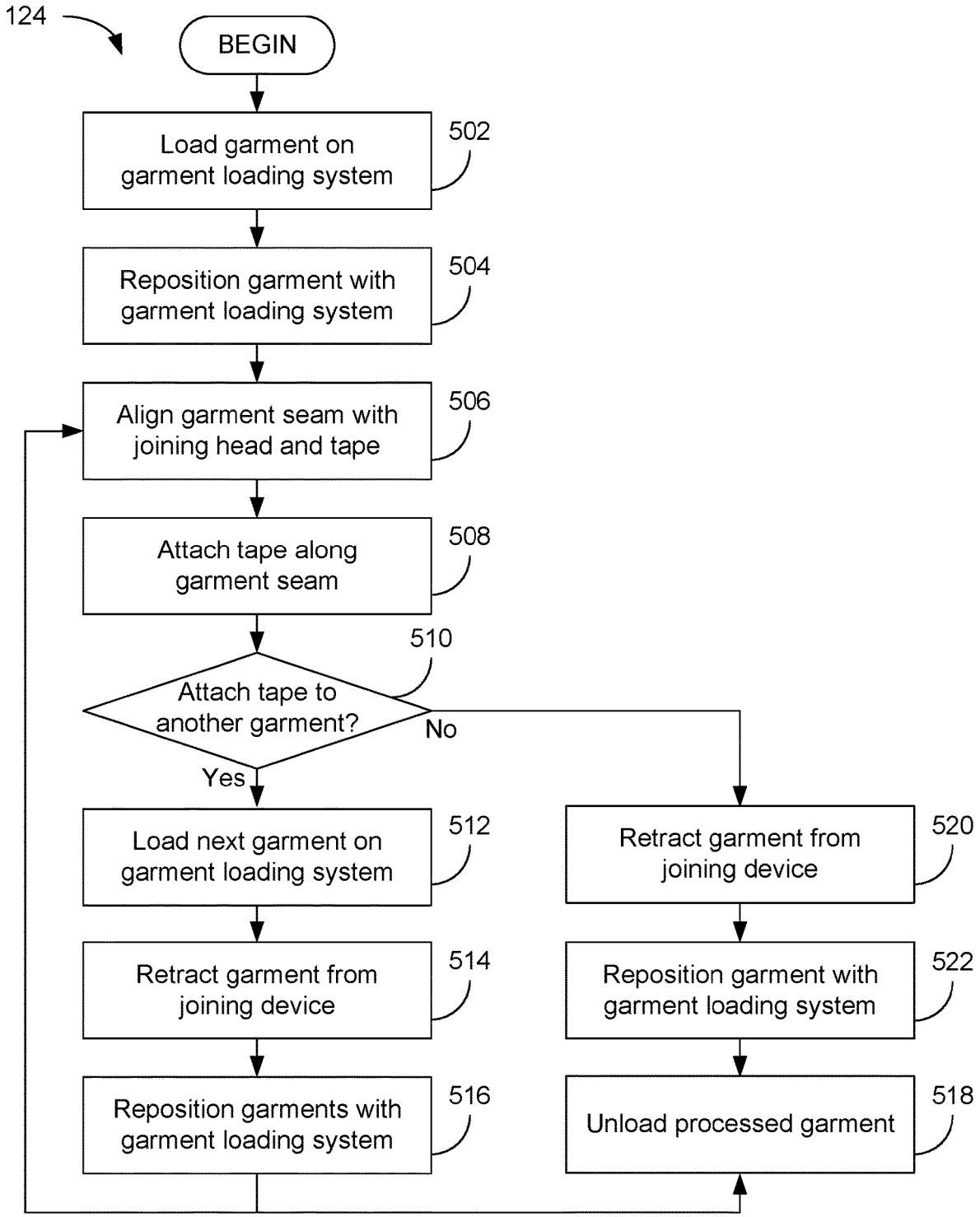
FIG. 5 illustrates an example of a tape attachment module, according to various embodiments of the present disclosure.

The flow chart of FIG. 5 shows the architecture, functionality, and operation of a possible implementation of the tape attachment module 124 (FIG. 1). The process begins at 502 where the garment is loaded on the garment loading system 126 (FIG. 2A). The garment can be loaded over the loading arm 202 away from the joining device 118. The seam position can be adjusted during loading to facilitate positioning and alignment with the joining head 238. The installation of the garment on the loading arm 202 can be accomplished manually by an operator or user, or can be automated using, e.g., an industrial robot with an end effector. The loading of the garment on the body holder 202 can be automatically initiated or can be initiated through an HMI 108 by an operator or user. In some embodiments, the loading arm 202 can be pivoted about its longitudinal axis to facilitate loading of the garment onto the loading arm 202.

At 504, garment can be repositioned by the garment loading system 126 to align the garment with the attachment arm 232 of the joining device. For example, the garment loading system 126 can be rotated about a vertical axis to align the distal end of the loading arm 202 with the distal end of the attachment arm 232 as shown in FIG. 2B. Sensor(s) can be used to align the two ends. The garment seam can then be aligned with the joining head and reinforcing tape or strip of material at 506. The placement of the garment seam can be accomplished manually by an operator or user, or can be automated using, e.g., an industrial robot with an end effector. This alignment of the garment seam can be controlled using information from one or more sensor(s) 122 (e.g., cameras or other vision device(s)) and one or more garment manipulator(s) 116 as previously discussed. By stretching the garment, the seam can be straightened to help with alignment and attachment of the reinforcing tape or strip of material. Once the seam has been aligned, the garment can be tensioned using the tensioner(s) 304 and/or wrinkle puller(s) 306 to remove wrinkles and tension the seam for attachment of the tape or material.

The reinforcing tape or material can then be attached along the seam of the garment at 508. One or more fabric manipulator(s), e.g., ply aligner 302 can adjust positioning of the garment on the loading arm 202 as the seam is fed into the joining head 238 to ensure proper alignment. Sensor(s) 122 such as cameras or other vision devices can be used to track the position of the seam based upon the sensor data and adjust the seam location using fabric manipulator(s) such as, e.g., ply aligner(s) 302, seam tensioner(s) 304 and/or wrinkle puller(s) 306 for proper attachment of the tape or material over the seam. When the reinforcing tape or strip of material is approaching the end of the seam, the tape or material can be severed by a knife device that can cut the tape or material before attachment is complete. In some embodiments, the tape can be folded over before beginning the attachment and then cutoff and folded under before being finished by the joining head 238.

If reinforcing tape or material is to be attached along a seam of another garment at 510, then the next garment can be loaded onto another loading arm 202 of the garment loading system 126 as discussed with respect to 502. The loading of the next garment can be carried out at the same time as the reinforcing tape or material is being attached at 508. When the seam attachment at 508 is completed, the processed garment can be retracted back from over the attachment arm 232 of the joining device 118 and onto the loading arm 202. For example, the puller wheel 234 (FIG. 2B), tensioner(s) 304 and/or garment manipulator(s) 116 can be used to pull the processed garment back onto the loading arm 292. In some embodiments, the user can manually return the processed garment to the loading arm 202. In some embodiments, the joining head 238 can be configured to attach the reinforcing tape or material in the opposite direction. For example, the garment can first be installed onto the joining device 118 and the reinforcing tape or material attached across the seam as the garment is returned to the loading arm 202.

In some implementations, the garment and/or the joining device 118 can be arranged to allow the processed garment to be ejected without returning to the loading arm 202. For instance, the garment material may be open (not closed) allowing it to pass through the joining head 138 and off the attachment arm 232 of the joining device 118 or the attachment arm 232 may be configured to allow the processed garment to exit from a second end. In various embodiments, the joining device 118 can be configured to allow the garment to be removed from the attachment arm 232 without passing back though or under the joining head 238. For example, the attachment arm 232 can be made detachable, allowing for the attachment arm and sewn product to be transported away from the joining head 238, where the garment can be removed. In various implementations, a second attachment arm 232 can installed while the first attachment arm 232 is removed, allowing for the next garment to begin processing. In this manor several attachment arms 232 can attach and detach, cycling though the system.

In other embodiments, the attachment arm 232 and the loading arm 202 can be rigidly attached to each other as a combined arm. Garments (or other products) can be loaded over both the attachment arm 232 and the loading arm 202 while the attachment arm 232 is away from the joining head 238, and likewise the processed garment (or other products) can be removed from the attachment arm 232 after the attachment arm 232 and the loading arm 202 have moved away from the joining head 238. This combined arm can be repositioned in a similar fashion as described for the garment loading system 126. The joining head 238 can be repositioned (e.g., translated or rotated) to provide clearance and access to the combined arm during loading and/or unloading.

In one embodiment, among others, the combined attachment arm 232 and loading arm 202 can be detachably supported at 2 or more locations along its length. For example, the combined arm can be detachably supported at or near the distal ends of the structure, allowing for a first support to detach and move out of the way during the loading of the garment, and then reattaching after loading. A second support can then detach at the completion of the processing, allowing for the processed garment to be removed without having to pass under or through the joining head 238.

In another example, the combined arm can be detachably supported at 4 locations: 2 supports located at or near the distal ends of the combined arm, and 2 supports located in between the outer supports. In this way, the combined arm can be functionally separated into 3 regions: a loading region, a processing region, and an unloading region. Operation of the supports can allow the combined arm to be supported by at least 2 supports at all times, while loading, unloading and/or processing is happening. For instance, the outer supports can be detached, while the inner supports are attached, allowing a first garment to be loaded into the loading region while a second garment is being processed in the processing region and while a third processed garment is being unloaded from the unloading region. After the loading, processing, and unloading of the first, second and third garments are completed, respectively, the outer support arms can attach to the combined arm, and the inner support arms can detach, allowing the second processed garment to move to the unloading region, and the first loaded garment to move to the processing region while another garment can be added to the loading region.

The combined arm can be shaped in a straight line or can be shaped to assist in loading, or unloading, or positioning of the garments as they are loaded, processed, or unloaded. For example, part or all of the unloading region can angle downward, allowing the garment to slide off of the combined arm. In another example, the combined arm can be shaped like a "U", such that garments (or other products) are loaded onto the combined arm on the same side of the system that they are removed from.

With the processed and next garment on the loading arms 202, the garment loading system 126 can again rotate about the vertical axis to reposition the garments. The process can then return to 506 where the seam of the next garment is aligned with the joining head 238 and the reinforcing tape or material. The processed garment can also be unloaded off the loading arm 202, either manually by the operator or automatically using, e.g., a garment manipulator 116.

If no additional garment is to be processed at 510, then when the attachment of the reinforcing tape or strip of material is complete at 508 the processed garment can be retracted onto the loading arm 202 at 520 (as discussed with respect to 514) and the garment loading system 126 can reposition the loading arms 202 at 522 (as discussed with respect to 516) and the processed garment can be unloaded at 518.

Functioning of the tape handling system 130 of the robotic system 102 will now be explained with reference to FIG. 6. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Figure 6:
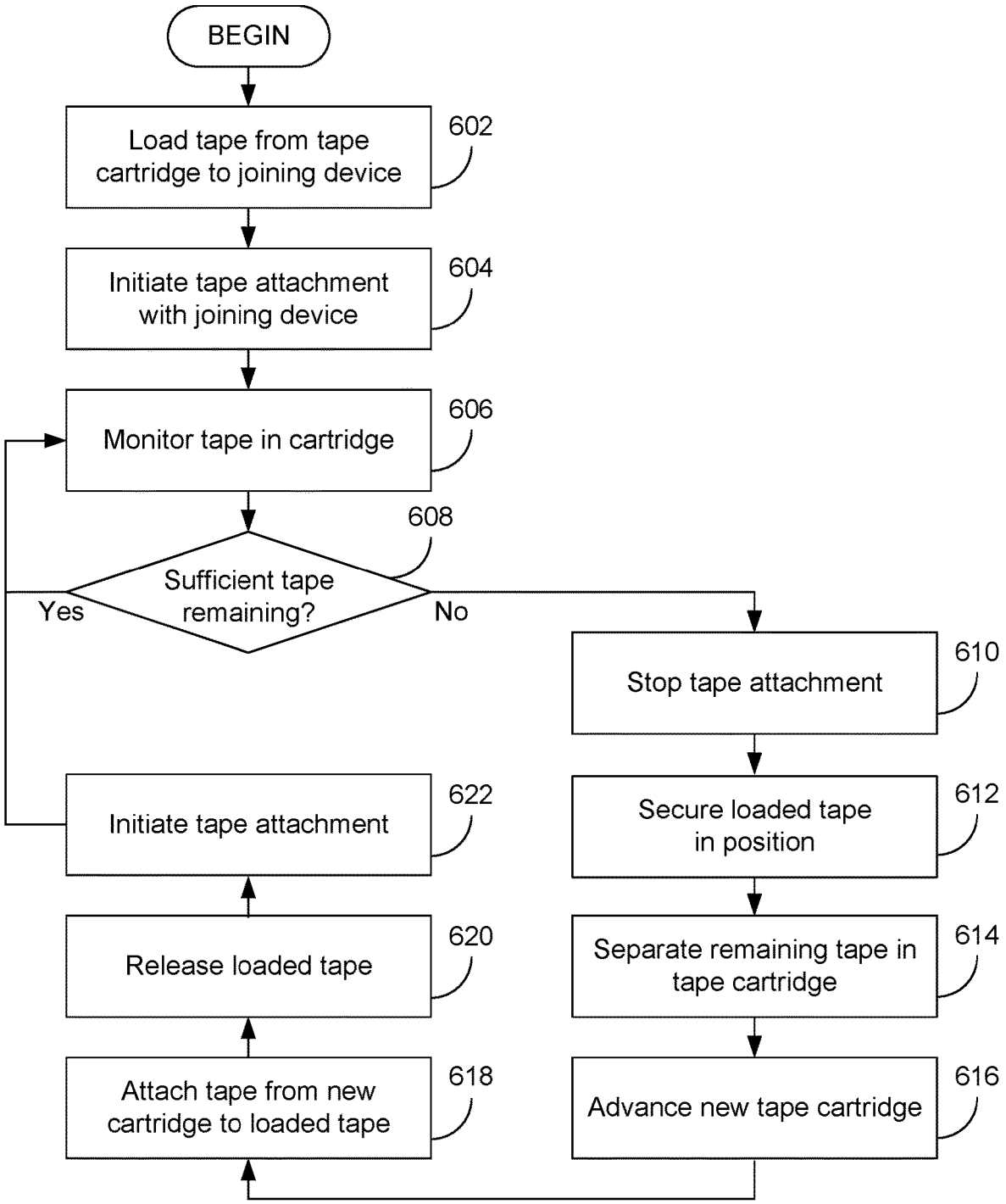
FIG. 6 illustrates an example of tape handling operation, according to various embodiments of the present disclosure.

The flow chart of FIG. 6 shows an example of the functionality and operation of a possible implementation of the tape handling system 130 (FIGS. 4A-4C). A tape cartridge assembly 402 can include one or more tape cartridges (or magazines) 410 that hold a spool or roll (or stack) of reinforcing tape or strip of material. Beginning at 602, tape from a tape cartridge 410 is loaded to the joining device 118. The tape cartridge 410 is positioned to align the tape outlet of the tape cartridge 410 with the tape guide 408. A cartridge advance control 414 can be used to control the movement of the tape cartridges 410 along a support (e.g., horizonal beam 416) for alignment with the tape guide 408. Cartridge location sensors 412 can be used to detect the position and/or alignment of the tape cartridge 410. With the tape cartridge 410 in position, the reinforcing tape or strip of material can be advanced from the tape outlet (either manually or in an automated fashion) and fed through the tape joining assembly 404 and through the tape guide 408 (as illustrated in FIGS. 4A and 4B) to the joining head 238. The reinforcing tape can be fed through a folding guide 310 (FIG. 3A) located adjacent to the joining head 238 to roll the edges of the tape before being attached over the seam by the joining head 238.

With the reinforcing tape supplied to the joining head 238, attachment of the tape by the joining device can be initiated at 604. At 606, the tape in the tape cartridge 410 is monitored as the reinforcing tape is dispensed and attached by the joining device 118. The amount of remaining reinforcing tape or strip of material can be monitored by, e.g., a sensor or sensors that detect the diameter of the roll (or height of the stack) of tape or material in the tape cartridge 410 or detect a marker embedded in or disposed on the tape or material a defined distance from the end of the tape. The amount of reinforcing tape or strip of material remaining in the tape cartridge 410 can be periodically checked. If there is sufficient reinforcing tape remaining in the tape cartridge 410 at 608, then the flow returns to 606 where monitoring of the tape in the cartridge 410 continues. If at 608 it is determined that there in not sufficient reinforcing tape or material remaining in the tape cartridge 410, then the tape handling system 130 can automatically supply a new roll (or stack) of reinforcing tape. Attachment of the reinforcing tape or strip of material can be paused while a replacement roll is provided, and then restarted with a minimal amount of down time.

When it is determined at 608 that there is not enough reinforcing tape or material remaining on the current roll, then attachment of the reinforcing tape can be stopped at 610. For example, the attachment of the reinforcing tape along a seam can be completed for a current garment and then stopped before attaching the reinforcing tape to the next garment. With the tape attachment process stopped, the loaded reinforcing tape or strip of material passing through the tape guide 408 can be secured in position at 612. For example, the tape joining assembly 404 can include, e.g., a solenoid or pneumatic cylinder that can apply a clamping force on the reinforcing tape or strip of material to secure it in place. Pressure can be applied to the reinforcing tape or strip of material passing through the tape joining assembly 404 at the beginning of the tape guide 408, e.g., a combination of fixed and/or movable clamping pads to hold it in place. With the reinforcing tape or strip of material held in place, the reinforcing tape or material remaining in the used tape cartridge 410 can be separated from the reinforcing tape or strip of material held in the tape joining assembly 404 at 614. A tape cutting assembly 406 can include a shear or knife device or other separation device configured to cut or sever the reinforcing tape or strip of material. In some cases, the tape may be used to an extent that it may not be necessary to cut the reinforcing tape or strip.

At 616, the used tape cartridge 410 can be replaced by advancing the next tape cartridge 410 along the support. The cartridge advance control 414 can control the movement of the tape cartridges 410 to position an unused spool or roll (or stack) of reinforcing tape or strip of material for use. For example, pins can extend downward through the support (e.g., beam 416) to engage with the tape cartridges 410 to control their movement. A first pin can extend through the structure to hold the current tape cartridge 410 in position. The tape cartridge 410 can be pressed against the first pin by, e.g., a spring or coil. When the used spool or roll (or stack) of reinforcing tape or material is approaching the end, a second pin can then be extended to allow the spent tape cartridge 410 to advance by a fixed amount when the first pin is retracted. With the first pin retracted, the used tape cartridge 410 is advanced and the next unused tape cartridge 410 moves into position to supply reinforcing tape or material. The first pin can then be extended again to hold the new tape cartridge 410 in position for use, and the second pin can be retracted to allow the used tape cartridge 410 to be removed. In this way, the tape cartridges 410 can automatically be advanced to supply the needed tape. In some embodiments, the used tape cartridge 410 can be manually replaced with a new tape cartridge 410.

With the new unused tape cartridge 410 in position, the reinforcing tape or strip of material can be extended or transported from the tape outlet and attached to the reinforcing tape or material loaded in the tape guide 408 and secured by the tape joining assembly 404 at 618. The free end of the reinforcing tape or strip of material from the new tape cartridge 410 can be advanced to align or overlap with the severed end of the secured tape or material by the tape joining assembly 404. For example, the tape cartridge 410 can be driven to advance the end of tape or strip of material into position in the tape joining assembly 404 or an actuator assembly can move and position the end of the tape or strip at the tape joining assembly 404 for joining. With the ends of the tapes or strips aligned or overlapped, the tape joining assembly 404 can then bond the ends of the tapes or material together using, e.g., adhesives, pressure or other appropriate bonding or joining schemes.

Once the new reinforcing tape or strip of material is attached, the tape joining assembly 404 can release the reinforcing tape or material at 620 and the attachment process can be initiated again at 622. In some cases, the reinforcing tape or strip of material including the joined portion can be attached over a seam. In other implementations, the reinforcing tape or strip of material can be advanced through the tape guide 408 and joining head 238, and the joined portion of the tape or material removed prior to initiating further attachment to a garment. While this wastes a portion of the reinforcing tape or material, it ensures that a continuous section of the reinforcing tape or material is attached over the seam. After initiating the tape attachment process with the new reinforcing tape or strip of material at 622, the flow returns to 606 where the tape or material in the tape cartridge 410 is monitored again.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

The invention claimed is:

1. A robotic system, comprising:

a joining device comprising a joining head configured to attach a tape or strip of material across a seam;

a loading system comprising a loading arm configured to support and position material comprising the seam for attachment of the tape or strip of material across the seam by the joining device, where a feed direction of the joining head is along a length of the loading arm when the loading arm is aligned with the joining device;

a seam feed system comprising a fabric manipulator configured to adjust positioning of the material on the loading arm aligned with the joining device, the fabric manipulator configured to maintain alignment of the seam along the feed direction of the joining head for attachment of the tape or strip of material across the seam; and a tape handling system configured to supply the tape or strip of material to the joining head of the joining device for attachment across the seam, where the tape or strip of material provided by the tape handling system covers the seam for attachment by the joining head and the fabric manipulator adjusts positioning of the material on the loading arm to align the seam with respect to the tape or strip of material and the joining head for attachment of the tape or strip of material across the seam.

2. The robotic system of claim 1, wherein the fabric manipulator adjusts the positioning of the material substantially perpendicular to the length of the loading arm.

3. The robotic system of claim 2, wherein the fabric manipulator is a ply aligner.

4. The robotic system of claim 3, wherein the ply aligner provides traction against the material substantially perpendicular to the length of the loading arm and concurrently allows movement of the material substantially parallel to the length of the loading arm.

5. The robotic system of claim 3, wherein the ply aligner comprises a series of rollers configured to move about the ply aligner to adjust the positioning of the material on a surface perpendicular to the feed direction along the loading arm.

6. The robotic system of claim 1, wherein the fabric manipulator adjusts the positioning of the material based upon a sensed position of the seam.

7. The robotic system of claim 6, wherein the loading arm comprises a light source configured to illuminate the seam in the material through a surface of the loading arm for sensing the position of the seam by a vision device.

8. The robotic system of claim 1, wherein the seam feed system comprises a wrinkle puller including a contact surface that engages the material on the loading arm, the wrinkle puller configured to tension the material across the loading arm substantially perpendicular to the feed direction.

9. The robotic system of claim 8, wherein the wrinkle puller applies a controlled force to the material to straighten the seam based upon sensed seam characteristics.

10. The robotic system of claim 1, wherein the seam feed system comprises seam tensioners located on opposite sides of the joining head of the joining device, the seam tensioners configured to contact the material and place the seam under tension during attachment of the tape or strip of material across the seam.

11. The robotic system of claim 10, wherein the seam tensioners comprise contacting surfaces positioned at an angle with respect to the feed direction of the joining head, the angle in a range from about 10 degrees to about 80 degrees.

12. The robotic system of claim 1, comprising a puller wheel located behind the joining head of the joining device opposite the loading arm, the puller wheel configured to assist in pulling the material through the joining head during attachment of the tape or strip of material.

13. The robotic system of claim 1, comprising at least one manipulator configured to return the material to the loading arm after attachment of the tape or strip of material across the seam.

14. The robotic system of claim 1, wherein the loading system comprises a second loading arm configured to support another material comprising a second seam for attachment of a tape or strip of material across the second seam by the joining device, the loading system configured to reposition and align the second loading arm with the joining device for attachment of the tape or strip of material across the second seam.

15. The robotic system of claim 14, wherein the loading system comprises a rotary assembly supporting the loading arms, the rotary assembly configured to rotate the loading arms to position and align each loading arm with the joining device for attachment of the tape or strip of material.

16. The robotic system of claim 1, wherein the tape handling system comprises a tape cartridge configured to dispense the tape or strip of material, wherein the tape or strip of material is directed to the joining head of the joining device via a tape guide.

17. The robotic system of claim 1, wherein the material is a garment comprising the seam.

18. The robotic system of claim 1, wherein the joining device is a sewing machine configured to sew the tape or strip of material across the seam.

19. A robotic system, comprising:

a joining device comprising a joining head configured to attach a tape or strip of material across a seam;

a vision device configured to track position of the seam as material comprising the seam is feed to the joining device for attachment of the tape or strip of material across the seam by the joining device;

a seam feed system comprising a fabric manipulator configured to adjust positioning of the material comprising the seam, the fabric manipulator aligning the seam along a feed direction of the joining head of the joining device for attachment of the tape or strip of material across the seam; and a tape handling system configured to supply the tape or strip of material to the joining head of the joining device for attachment across the seam, where the tape or strip of material provided by the tape handling system covers the seam for attachment by the joining head and the fabric manipulator adjusts positioning of the material to align the seam with respect to the tape or strip of material and the joining head for attachment of the tape or strip of material across the seam based at least in part upon the tracked position of the seam.

20. The robotic system of claim 19, wherein the vision device is a camera.

21. The robotic system of claim 19, comprising a light source configured to illuminate the seam in the material.

22. The robotic system of claim 21, wherein the light source is positioned to illuminate the seam from a side of the material opposite the vision device.

23. The robotic system of claim 19, wherein the material comprising the seam is fed to the joining device over a loading surface.

24. The robotic system of claim 23, wherein a loading arm configured to support the material comprising the seam for attachment of the tape or strip of material across the seam by the joining device comprises the loading surface.

25. The robotic system of claim 24, wherein the loading arm comprises a light source configured to illuminate the seam in the material through the loading surface for tracking the position of the seam by the vision device.

26. The robotic system of claim 24, wherein the material comprising the seam is fed to the joining device along a length of the loading arm and the fabric manipulator adjusts the positioning of the material substantially perpendicular to the length of the loading arm.

* * * * *